US012774145B2

(12) United States Patent
Hammerschmidt et al.

(10) Patent No.: US 12,774,145 B2
(45) Date of Patent: Oct. 27, 2026

(54) CUSHIONING DEVICES HAVING UNITARY BODIES IN LOOPED CONFIGURATIONS

(71) Applicant: Sealed Air Verpackungen GMBH, Charlotte, NC (US)

(72) Inventors: Christof Hammerschmidt, Auringen Hessen (DE); Sven Lyding, Schenklengsfeld Hessen (DE)

(73) Assignee: Sealed Air Verpackungen GMBH, Charlotte, NC (US)

( * ) Notice: Subject to any disclaimer, the term of this patent is extended or adjusted under 35 U.S.C. 154(b) by 0 days.

(21) Appl. No.: 18/872,322

(22) PCT Filed: May 31, 2023

(86) PCT No.: PCT/US2023/023952

§ 371 (c)(1),
(2) Date: Dec. 6, 2024

(87) PCT Pub. No.: WO2023/239571

PCT Pub. Date: Dec. 14, 2023

(65) Prior Publication Data

US 2025/0353656 A1 Nov. 20, 2025

Related U.S. Application Data

(60) Provisional application No. 63/349,639, filed on Jun. 7, 2022.

(51) Int. Cl.
*B65D 81/05* (2006.01)

(52) U.S. Cl.
CPC .... *B65D 81/053* (2013.01); *B65D 2585/6837* (2013.01); *B65D 2585/6882* (2013.01)

(58) Field of Classification Search
CPC ..... B65D 81/053; B65D 2585/6837; B65D 2585/6882; B65D 81/054; B65D 81/055; B65D 1/056; B65D 81/057; B65D 81/058
(Continued)

(56) References Cited

U.S. PATENT DOCUMENTS 2,741,362 A * 4/1956 Cortright ..... B65D 85/48 206/453
2,807,360 A * 9/1957 Nurre ..... B65D 85/48 220/920

(Continued)

FOREIGN PATENT DOCUMENTS

EP 0667304 A2 8/1995

*Primary Examiner* — Rafael A Ortiz
(74) *Attorney, Agent, or Firm* — Jason R. Womer

(57) ABSTRACT

A cushioning device has a unitary body formed from a resilient material. The unitary body has a length, a width, and a thickness; first and second ends located opposite each other in a direction of the length of the unitary body; first and second coupling mechanisms located on the first and second ends of the unitary body; and a slot through the thickness of the unitary body. The length of the unitary body is greater than the width of the unitary body. When the unitary body is in a looped configuration, the first and second coupling mechanisms are couplable to each other to hold the unitary body in the looped configuration. When the unitary body is in the looped configuration, the slot is capable of having a side or a corner of an object slid therethrough so that the unitary body in the looped configuration provides cushioning for the object.

5 Claims, 17 Drawing Sheets

(58) Field of Classification Search
USPC ..... 206/586, 587, 453
See application file for complete search history.

(56) References Cited

U.S. PATENT DOCUMENTS

| | | | | | |
|---|---|---|---|---|---|
| 2,896,832 | A * | 7/1959 | Lane | B65D 81/057 | 206/453 |
| 3,843,038 | A * | 10/1974 | Sax | B65D 81/056 | 206/586 |
| 3,900,156 | A * | 8/1975 | Clark, Jr. | B65D 81/056 | 206/586 |
| 3,994,433 | A | 11/1976 | Jenkins et al. | | |
| 4,784,269 | A * | 11/1988 | Griffith | B65D 81/03 | 493/69 |
| 5,386,911 | A * | 2/1995 | Payne | B65D 81/075 | 220/531 |
| 6,082,543 | A * | 7/2000 | Beliveau | B65D 81/022 | 206/523 |
| 2003/0057128 | A1* | 3/2003 | Hardy | B65D 81/1275 | 206/453 |
| 2005/0115860 | A1* | 6/2005 | Mertz, II | B65D 5/324 | 206/521 |
| 2008/0210588 | A1 | 9/2008 | Stegner et al. | | |
| 2012/0031807 | A1* | 2/2012 | Shimomichi | B65D 81/057 | 206/586 |
| 2017/0113862 | A1* | 4/2017 | Malone | B65D 81/1075 | |
| 2017/0137200 | A1* | 5/2017 | Hudson | B65D 81/057 | |
| 2019/0233194 | A1* | 8/2019 | Zhang | B65D 81/057 | |

* cited by examiner

CUSHIONING DEVICES HAVING UNITARY BODIES IN LOOPED CONFIGURATIONS

BACKGROUND

The present disclosure is in the technical field of object cushioning. More particularly, the present disclosure is directed to cushions having a unitary body that can be placed in a looped configuration to provide cushioning for a side or a corner of an object.

Packaging materials have been used to provide cushioning and void fill. Especially with the rise of ecommerce, protecting consumer items during shipment has become a common need. Many solutions have been developed for providing cushioning and void fill. Existing solutions include air cellular materials (e.g., BUBBLE WRAP air cellular sheets), air pillows (e.g., FILL-AIR air pillows), crumpled paper (e.g., crumpled kraft paper), loose fill (e.g., packing peanuts), foam-in-bag packaging (e.g., INSTAPAK foam-in-bag packaging), polystyrene foam blocks (e.g., STYROFOAM blocks), and other packaging materials. These packaging materials tend to be lightweight so that the packaging materials add as little weight as possible.

One difficulty in the use of lightweight packaging materials is providing properly cushioning for the items being shipped. In particular, the sides and corners of items—especially heavy items—need protection that is difficult to provide with lightweight materials. Some existing side or corner protection devices can be specifically designed for one particular item, such as polystyrene foam blocks or foam-in-bag packaging. However, highly-specific polystyrene foam blocks do not store easily before use and cannot be used for items of different shapes. Foam-in-bag packaging typically conforms uniquely to a single item, cannot be reused with other items, and typically is implemented with significant machinery. Other existing side or corner protection devices, such as air cellular materials or crumpled paper, require a high level of skill and proper execution from a packer to provide the appropriate cushioning for objects. It is difficult to train packers in this way and even the best of packers is susceptible to human error. Other more complex designs have been made to form a corner cushion from a cushioning material. Examples of more complex designs include complete endcaps that are formed by folding and coupling pieces of cushioning material, such as those shown in U.S. Patent Application Publication No. 2008/0210588 and in U.S. Pat. Nos. 3,994,433 and 6,082,543. However, such multi-piece designs require time and skill for packers to assemble and are subject to human error and other modes of failure associated with their complexity.

It would be advantageous to have a side or corner cushioning device that can be easily stored prior to use, is versatile in that it can be used with multiple types of objects, requires a low level of skill to use, is not easily susceptible to human error, and can be easily reused.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In a first embodiment, a cushioning device has a unitary body formed from a resilient material. The unitary body has a length, a width, and a thickness, wherein the length of the unitary body is greater than the width of the unitary body. The unitary body has first and second ends located opposite each other in a direction of the length of the unitary body. The unitary body has first and second coupling mechanisms located on the first and second ends of the unitary body. When the unitary body is in a looped configuration, the first and second coupling mechanisms are configured to be coupled to each other to hold the unitary body in the looped configuration. The unitary body has a slot through the thickness of the unitary body. When the unitary body is in the looped configuration, the slot is capable of having a side or a corner of an object slid therethrough so that the unitary body in the looped configuration provides cushioning for the side or the corner of the object.

In a second embodiment, the resilient material of the first embodiment comprises a polyethylene foam material.

In a third embodiment, the slot of any of the preceding embodiments extends in the direction of the length of the unitary body.

In a fourth embodiment, the slot of the third embodiment is substantially centered on the unitary body in a direction of the width.

In a fifth embodiment, the slot of the fourth embodiment is off center in the direction of the length of the unitary body.

In a sixth embodiment, sides of the slot of any of the preceding embodiments have a sawtooth wave shape.

In a seventh embodiment, sides of the slot of any of the first through fifth embodiments have one or more of a square wave shape, a sine wave shape, a convex shape, or semicircular shapes.

In an eighth embodiment, sides of the slot of any of the first through fifth embodiments are straight.

In a ninth embodiment, the cushioning device of any of the preceding embodiments is configured such that the first coupling mechanism has a hammerhead shape that includes a neck and the second coupling mechanism has through hole. When the first and second coupling mechanisms are coupled to each other, the neck of the first coupling mechanism passes through the through hole of the second coupling mechanism.

In a tenth embodiment, the through hole of the second coupling mechanism of the ninth embodiment is located proximate one of the first and second ends of the unitary body, and wherein the unitary body further includes a slit between the through hole and the one of the first and second ends.

In an eleventh embodiment, the cushioning device of any of the preceding embodiments is configured such that the first coupling mechanism has a trapezoidal shape and the second coupling mechanism has a through hole having a graduated shape. When the first and second coupling mechanisms are coupled to each other, the trapezoidal shape of the first coupling mechanism seats against the graduated shape in the through hole of the second coupling mechanism.

In a twelfth embodiment, the cushioning device of any of the preceding embodiments is configured such that the first coupling mechanism has a convex arcuate shape and the second coupling mechanism has through hole having a concave arcuate shape. When the first and second coupling mechanisms are coupled to each other, the convex arcuate shape of the first coupling mechanism seats against the concave arcuate shape in the through hole of the second coupling mechanism.

In a thirteenth embodiment, the slot of any of the preceding embodiments extends from a long side of the unitary body.

In a fourteenth embodiment, the unitary body of the thirteenth embodiment is further configured to be coupled to a second unitary body in a looped configuration. The second unitary body comprises: (i) a length, a width, and a thickness, wherein the length of the unitary body is greater than the width of the unitary body, (ii) first and second ends located opposite each other in a direction of the length of the second unitary body, (iii) first and second coupling mechanisms located on the first and second ends of the second unitary body, and (iv) a slot through the thickness of the second unitary body, wherein the slot extends from a long side of the second unitary body. When the unitary body and the second unitary body are coupled together in a looped configuration, the first coupling mechanisms of the are unitary body and the second unitary body are configured to be coupled to each other and the second coupling mechanisms of the are unitary body and the second unitary body are configured to be coupled to each other to hold the unitary body and the second unitary body together such that the object can pass through the slots of the unitary body and the second unitary body.

In a fifteenth embodiment, the object of the fourteenth embodiment is an elongated object.

In a sixteenth embodiment, the slots of the unitary body and the second unitary body of the fifteenth embodiment are oriented such that closed ends of the slots contact opposite sides of the elongated object.

In a seventeenth embodiment, sides of the slots of any of the fourteenth and fifteenth embodiments contact the elongated object to hold the relative positions of the object with respect to each of the unitary body and the second unitary body.

In an eighteenth embodiment, the slot of any of the preceding embodiments comprises four slots.

In a nineteenth embodiment, the cushioning device of the eighteenth embodiment is configured to be looped around the object when the unitary body is in the looped configuration.

In a twentieth embodiment, the object of the nineteenth embodiment is generally rectangular in shape having four corners and, when the unitary body is in the looped configuration around the object, each of the corners of the object is located in one of the slots of the cushioning device.

In a twenty-first embodiment, the slot of any of the preceding embodiments comprises a plurality of slits.

In a twenty second embodiment, the plurality of slits of the twenty-first embodiment extend in a length direction of the unitary body and are substantially centered in a width direction of the unitary body.

In a twenty-third embodiment, a package includes a container and an object located within the container. The object has a plurality of corners. The package further includes a plurality of cushioning devices, where each of the plurality of cushioning devices is located between one of the plurality of corners of the object and the container, and where each of the plurality of cushioning devices is a cushioning device according to any of the preceding embodiments.

In a twenty-fourth embodiment, the object of the twenty-third embodiment has a contoured surface.

In a twenty-fifth embodiment, the object of the twenty-fourth embodiment is a windshield or a windscreen.

In a twenty-sixth embodiment, the object of the twenty-fourth embodiment is a curved flatscreen television.

In a twenty-seventh embodiment, at least one of the plurality of corners of the object of any of the twenty-third to twenty-sixth embodiments is a rounded corner.

In a twenty-eighth embodiment, the object of any of the twenty-third to twenty-seventh embodiments has substantially planar surfaces.

In a twenty-ninth embodiment, the object of the twenty-eighth embodiment is a flatscreen television.

In a thirtieth embodiment, the container of any of the twenty-third to twenty-ninth embodiments is a shipping box. The width of each of the plurality of cushioning devices is located between front and back surfaces of the shipping box.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The present disclosure describes embodiments of cushioning devices that have a unitary body formed from a resilient material. The unitary body has a length, a width, and a thickness; first and second ends located opposite each other in a direction of the length of the unitary body; first and second coupling mechanisms located on the first and second ends of the unitary body; and a slot through the thickness of the unitary body. The length of the unitary body is greater than the width of the unitary body. When the unitary body is in a looped configuration, the first and second coupling mechanisms are couplable to each other to hold the unitary body in the looped configuration. When the unitary body is in the looped configuration, the slot is capable of having a side or a corner of an object slid therethrough so that the unitary body in the looped configuration provides cushioning for the side or the corner of the object.

Figure 1A:
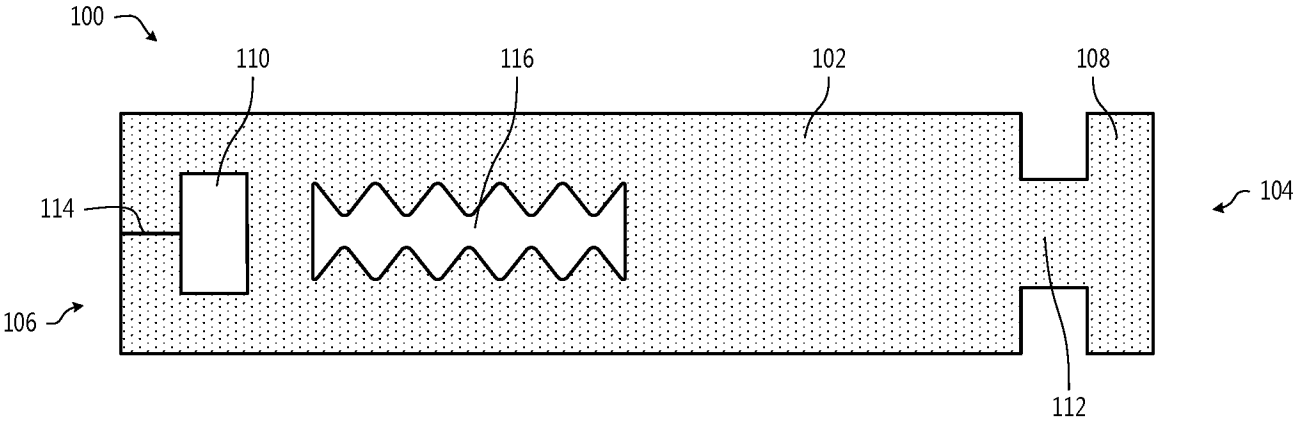
FIGS. 1A and 1B depict front and side views, respectively, of a cushioning device that includes a unitary body, in accordance with the embodiments disclosed herein.
Figure 1B:
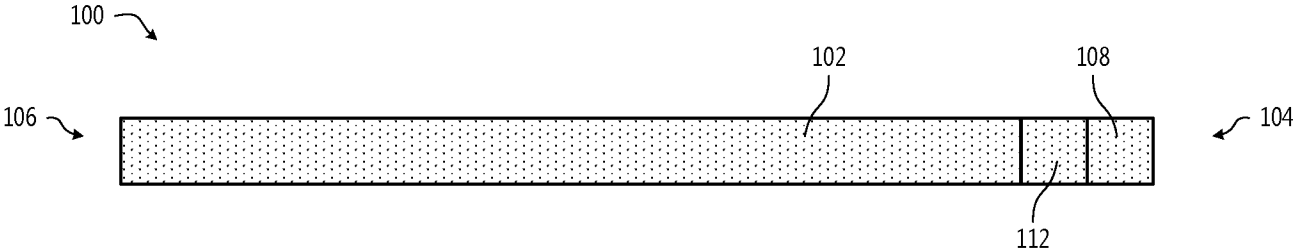

FIGS. 1A and 1B depict front and side views, respectively, of a cushioning device 100. The cushioning device 100 includes a unitary body 102. As used herein, the term "unitary body" refers to a body formed from a single unit or a uniform entity. The unitary body 102 is formed from a resilient material. In some embodiments, the resilient material is a polyethylene foam material. In other embodiments, the resilient material is another type of foam material, a foam material, or any other type of resilient material. In the depicted embodiment, the unitary body 102 has a length (shown in the left-to-right direction when viewing FIGS. 1A and 1B), a width (shown in the top-to-bottom direction when viewing FIG. 1A), and a thickness (shown in the top-to-bottom direction when viewing FIG. 1B). The length of the unitary body 102 is greater than the width of the unitary body 102. In the depicted embodiment, the unitary body 102 is generally in the shape of a rectangular prism.

The unitary body 102 of the cushioning device 100 includes a first end 104 and a second end 106. The first and second ends 104 and 106 are located opposite each other in a direction of the length of the unitary body 102. In the depicted embodiment, when viewing FIGS. 1A and 1B, the first end 104 is located on the right side of the unitary body 102 and the second end 106 is located on the left side of the unitary body 102. It will be understood that the unitary body 102 could be rotated so that the first end 104 would be located on the left side of the unitary body 102 and the second end 106 would be located on the right side of the unitary body 102.

The unitary body includes a first coupling mechanism 108 and a second coupling mechanism 110. In the depicted embodiment, the first coupling mechanism 108 is located on the first end 104 of the unitary body 102 and the second coupling mechanism 110 is located on the second end 106 of the unitary body 102. It will be understood that, in other embodiments, the first coupling mechanism 108 could be located on the second end 106 and the second coupling mechanism 110 could be located on the first end 104. The unitary body 102 is shown in FIGS. 1A and 1B in a flat configuration. As is discussed in greater detail below, the unitary body 102 can be bent into a looped configuration. When the unitary body 102 is in the looped configuration, the first and second coupling mechanisms 108 and 110 are configured to be coupled to each other to hold the unitary body 102 in the looped configuration.

In the depicted embodiment, the first coupling mechanism 108 has a hammerhead shape that includes a neck 112. The second coupling mechanism 110 has through hole. In the depicted embodiment, the through hole of the second coupling mechanism 110 has a width that is equal to or greater than a width of the neck 112. In this way, when the first and second coupling mechanisms 108 and 110 are coupled to each other, the neck 112 of the first coupling mechanism 108 passes through the through hole of the second coupling mechanism 110. In the depicted embodiment, the through hole of the second coupling mechanism 110 is located proximate the second end 106 of the unitary body 102 and the unitary body 102 further includes a slit 114 between the through hole and the second end 106. As discussed below, portions of the unitary body 102 on either side of the slit 114 can be pulled apart such that the neck 112 can be slide though the second end 106 and into the through hole of the second coupling mechanism 110. Other embodiments of first and second coupling mechanisms that can be used in unitary bodies are discussed below.

The unitary body 102 of the cushioning device 100 also includes a slot 116. When the unitary body 102 is in the looped configuration, the slot 116 is capable of having a side or a corner of an object slid therethrough so that the unitary body 102 in the looped configuration provides cushioning for the side or the corner of the object. In the depicted embodiment, the slot 116 is substantially centered on the unitary body 102 in the width direction and extends in the direction of the length of the unitary body 102. In the depicted embodiment, the slot 116 is off-center on the unitary body 102 with respect to the length direction. In some embodiments, the slot 116 is located on the unitary body 102 on one half of the unitary body 102 in the length direction. In the depicted embodiment, the slot 116 is located on the unitary body 102 on the half of the unitary body 102 on the left when viewing FIG. 1A. In other embodiments, the slot 116 can be centered on the unitary body 102 in the length direction. In such a case, the slot 116 can be located at the apex of a looped configuration of the unitary body 102 when the unitary body 102 is bent into the looped configuration. While the embodiments described herein show the slot being in an off-centered position in the length direction, the slot in any of the embodiments could also be centered in the length direction.

The slot 116 can have sides with a particular shape. In the depicted embodiment, the sides of the slot 116 have a sawtooth wave shape. In other embodiments, as discussed in greater detail below, the sides of the slot in a unitary body can have one or more of a square wave shape, a sine wave shape, a convex shape, or semicircular shapes. In yet other embodiments, the sides of the slot in a unitary body of the slot can be straight. The sides of a slot can have any other shape. In some embodiments, the sides of the slot 116 can be selected based on a particular use or based on a particular object which is expected to have a side or a corner thereof inserted into the slot 116.

Figure 2:
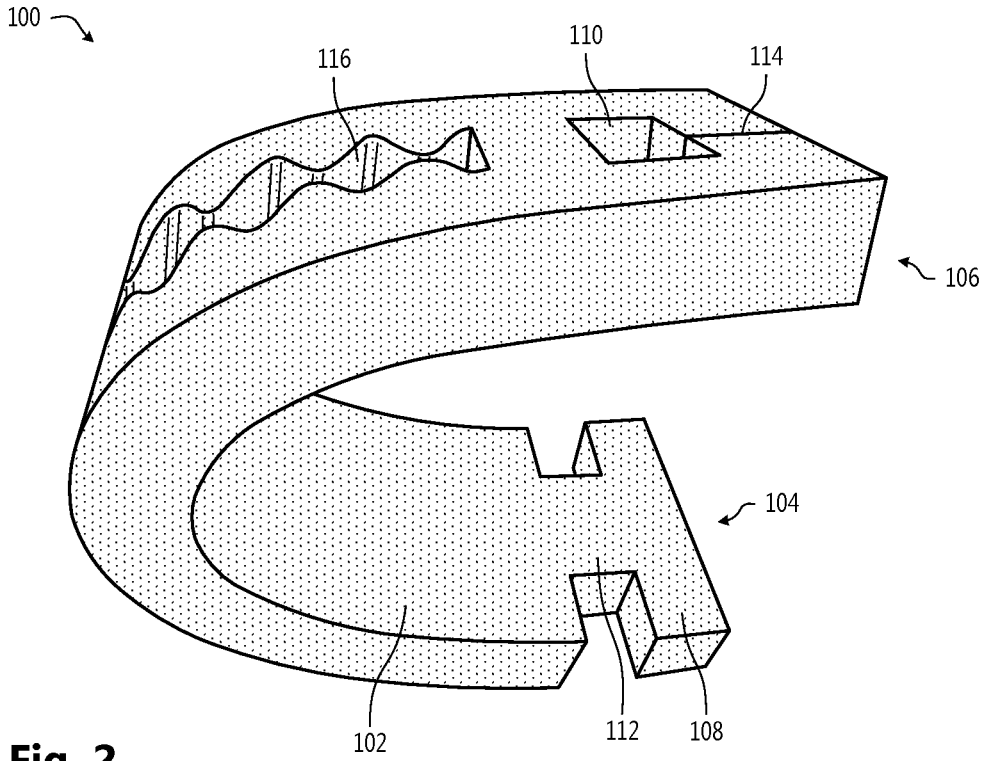
FIGS. 2 and 3 depict instances of the cushioning device shown in FIGS. 1A and 1B being formed from the flat configuration into the looped configuration, in accordance with the embodiments disclosed herein.
Figure 3:
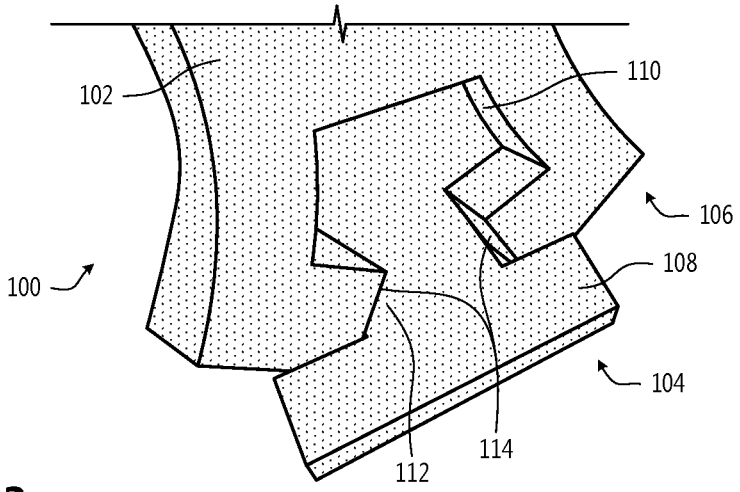

As discussed above, cushioning device 100 can be formed from the flat configuration shown in FIGS. 1A and 1B into a looped configuration. FIGS. 2 and 3 depict instances of the cushioning device 100 being formed from the flat configuration into the looped configuration. In FIG. 2, the unitary body 102 has been bent such that the second end 106 is approaching the first end 104. The bending of the unitary body 102 exposes the slot 116 on the outer side of the bend. It will be apparent that the unitary body 102 can be bent in either direction—either the direction shown in FIG. 2 or in the opposite direction—to achieve the looped configuration.

FIG. 3 depicts that the unitary body 102 has been bend further until the first and second ends 104 and 106 are in contact with each other. At the instant shown in FIG. 3, the portions of the second end 106 on either side of the slit 114 have been separated so that the neck 112 of the first coupling mechanism 108 can be slid between the slit 114. From the position shown in FIG. 3, the second end 106 can be pushed further in the direction of the first end 104 until the neck 112 of the first coupling mechanism 108 is fully located in the through hole of the second coupling mechanism 110. After the neck 112 of the first coupling mechanism 108 is fully located in the through hole of the second coupling mechanism 110, the first and second coupling mechanisms 108 and 110 are coupled to each other to hold the unitary body 102 in the looped configuration.

Figure 4A:
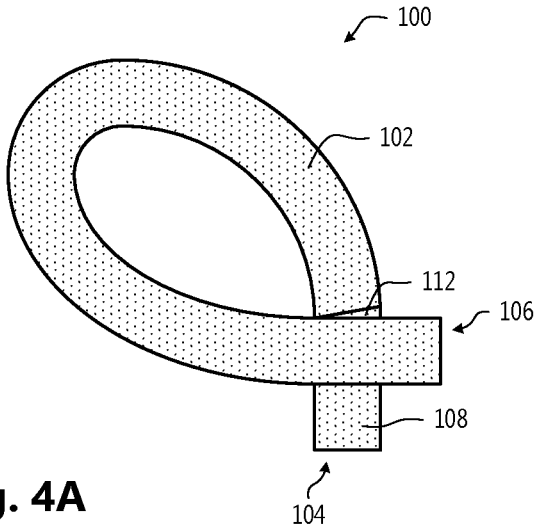
FIGS. 4A and 4B depict front and side views, respectively of the cushioning device shown in FIGS. 1A and 1B with the unitary body in the looped configuration, in accordance with the embodiments disclosed herein.
Figure 4B:
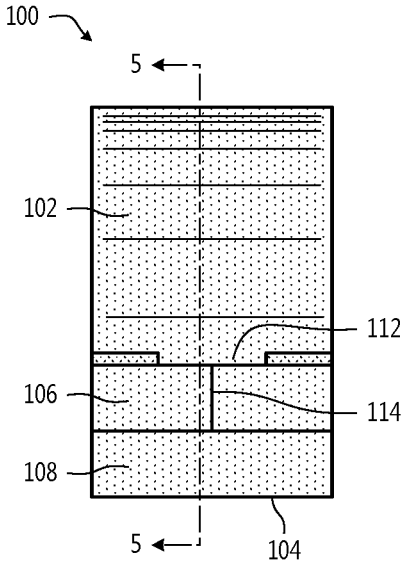
Figure 5:
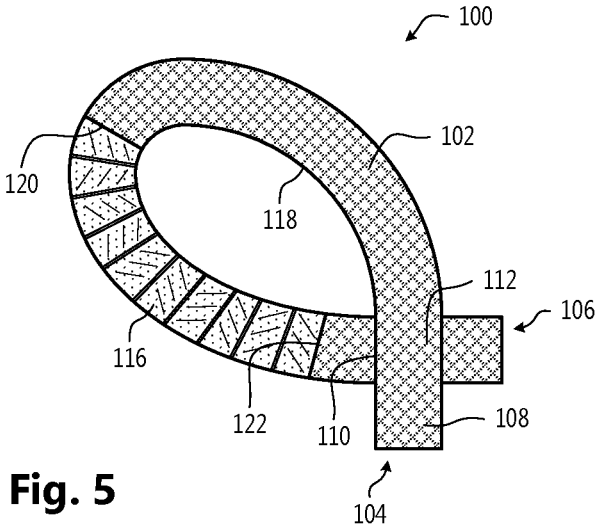
FIG. 5 depicts a side cross-sectional view of the cushioning device shown in FIGS. 1A and 1B with the unitary body in the looped configuration, in accordance with the embodiments disclosed herein.

FIGS. 4A and 4B depict front and side views, respectively of the cushioning device 100 with the unitary body 102 in the looped configuration. FIG. 5 depicts a side cross-sectional view of the cushioning device 100 with the unitary body 102 in the looped configuration. The first and second coupling mechanisms 108 and 110 are coupled to each other—with the neck 112 of the first coupling mechanism 108 located in the through hole of the second coupling mechanism 110—to hold the unitary body 102 in the looped configuration. In the depicted embodiment, the neck 112 of the first coupling mechanism 108 has passed completely beyond the slit 114 so that the portions of the unitary bod on either side of the slit 114 can returned to their original position and deter removal of the neck 112 from the through hole of the second coupling mechanism 110. As can be seen in FIGS. 4A and 5, the looped configuration is not necessarily in the shape of a perfect circle or a perfect oval. Instead, the looped configuration merely denotes that one portion of the unitary body 102 is looped back to another portion of the unitary body 102 so that the unitary body 102 is looped back on itself.

As can be seen in FIG. 5, with the unitary body 102 in the looped configuration, the slot 116 of the depicted embodiment is located on one side of the loop of the unitary body 102. In particular, the slot 116 is located on the bottom left side of the unitary body 102 when viewing FIGS. 4A and 5. In that configuration, a side or a corner of an object can be slid through the slot 116. For example, the side or the corner of the object can be slit through the slot 116 until the object is cushioned in one or more of the following ways: the corner contacts a portion 118 of the unitary body 102 that does not include the slot 116 (e.g., the top right portion 118 of the unitary body 102 when viewing FIGS. 4A and 5), a side of the object contacts one edge 120 of the slot 116 (e.g., the left edge 120 of the unitary body 102 when viewing FIGS. 4A and 5), and/or a side of the object contacts another edge 122 of the slot 116 (e.g., the right edge 122 of the unitary body 102 when viewing FIGS. 4A and 5).

One benefit of the cushioning device 100 with the unitary body 102 in the looped configuration is that the same cushioning device 100 can be used in multiple orientations. For example, the cushioning device 100 can be used to cushion one corner of an object in the orientation show in FIGS. 4A and 5. The cushion 100 can be flipped or rotated into another orientation to cushion another corner of the object. In this way, multiple cushioning devices that are copies of the cushioning device 100 can be used to cushion each corner of a multi-corner object.

Figure 6:
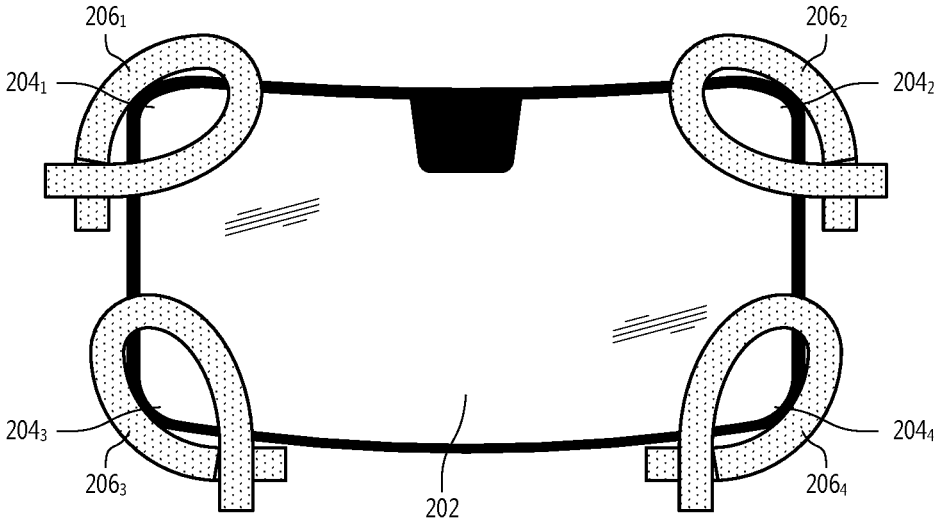
FIG. 6 depicts an embodiment of an object having multiple corners that are cushioned by multiple units of a cushioning device, in accordance with the embodiments disclosed herein.

FIG. 6 depicts an embodiment of an object having multiple corners that are cushioned by multiple units of a cushioning device. In particular, FIG. 6 depicts an object 202 that has corners $\mathbf{204}_1$, $\mathbf{204}_2$, $\mathbf{204}_3$, $\mathbf{204}_4$ (collectively, corners 204). In the depicted embodiment, the object 202 is a windshield or a windscreen and each of the corners 204 is a rounded corner. FIG. 6 depicts that each of the corners $\mathbf{204}_1$, $\mathbf{204}_2$, $\mathbf{204}_3$, $\mathbf{204}_4$ is cushioned, respectively, by cushioning devices $\mathbf{206}_1$, $\mathbf{206}_2$, $\mathbf{206}_3$, $\mathbf{206}_4$ (collectively, cushioning devices 206). In some embodiments, each of the cushioning devices 206 is a unit of the cushioning device 100. In some embodiments, each of the cushioning devices 206 is one of the various cushioning devices described herein.

In the depicted embodiment, each of the cushioning devices 206 is in the looped configuration with the first and second coupling mechanisms coupling the first and second ends of the cushioning device. Each of corners 204 of the object 202 has been slid through the slot of one of the cushioning devices 206: the corner $\mathbf{204}_1$ has been slid through the slot of the cushioning device $\mathbf{206}_1$, the corner $\mathbf{204}_2$ has been slid through the slot of the cushioning device $\mathbf{206}_2$, the corner $\mathbf{204}_3$ has been slid through the slot of the cushioning device $\mathbf{206}_3$, and the corner $\mathbf{204}_4$ has been slid through the slot of the cushioning device $\mathbf{206}_4$. In the depicted embodiment, the cushioning devices 206 have been oriented with respect to the object 202 such that the two coupled ends of each of the cushioning devices $\mathbf{206}_1$ and $\mathbf{206}_2$ are located to the sides of the object 202 and the two coupled ends of each of the cushioning devices $\mathbf{206}_3$ and $\mathbf{206}_4$ are located below the bottom of the object 202.

Figure 7A:
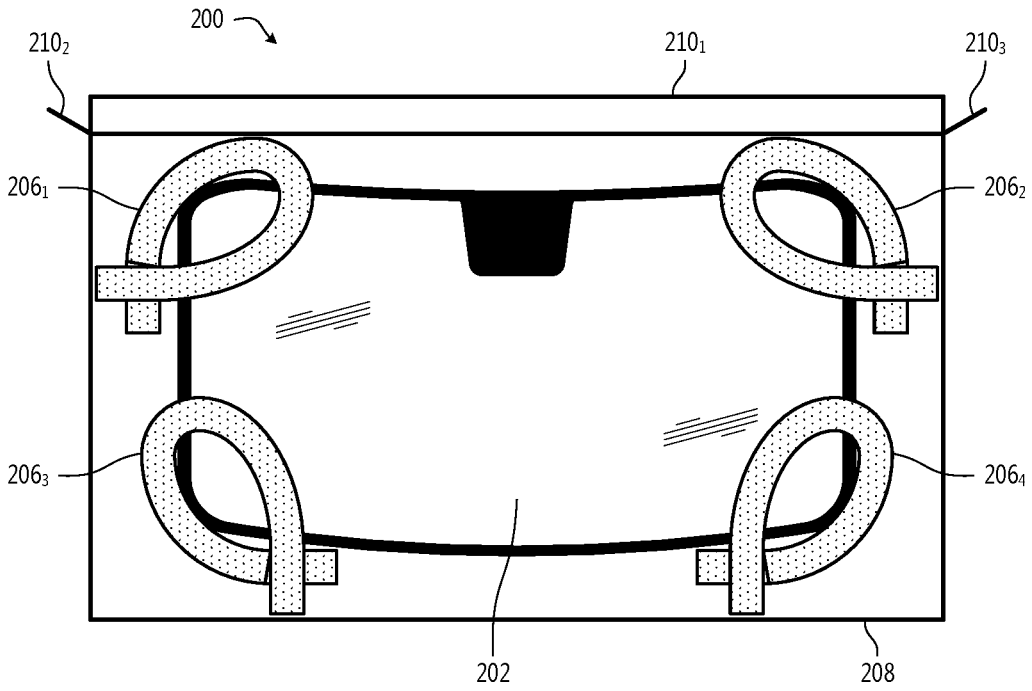
FIGS. 7A and 7B depict, respectively, front and top views of a package that includes the object and the cushioning devices shown in FIG. 6, in accordance with the embodiments disclosed herein.
Figure 7B:
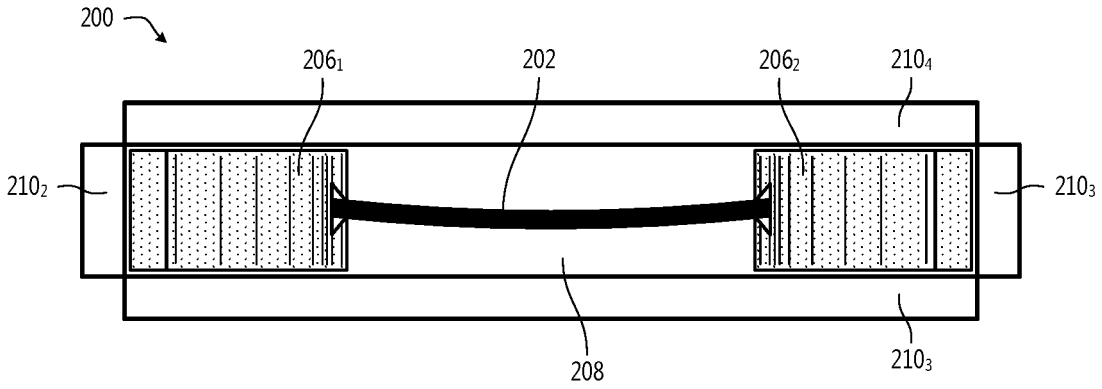

The object 202 and the cushioning devices 206 can be inserted into a container to form a package. FIGS. 7A and 7B depict, respectively, front and top views of a package 200 that includes the object 202 and the cushioning devices 206. The package 200 includes a container 208. The container is shown in FIGS. 7A and 7B as being transparent for ease in viewing the object 202 and the cushioning devices 206. In other embodiments, the container 208 can be opaque or translucent. For example, the container 208 can be a shipping container (e.g., a cardboard box), storage bin (e.g., a plastic storage bin), or any other type of container. In the depicted embodiment, the bottom of the container 208 is closed and the top of the container 208 is open. The container 208 includes flaps $\mathbf{210}_1$, $\mathbf{210}_2$, $\mathbf{210}_3$, $\mathbf{210}_4$ (collectively, flaps 210) that are shown as being open in FIGS. 7A and 7B.

When the flaps 210 are open, the object 202 and the cushioning devices 206 can be inserted into the container 208 until the object 202 and the cushioning devices 206 are in the positions shown in FIGS. 7A and 7B. In the arrangement shown in FIGS. 7A and 7B, each of the cushioning devices 206 is located between one of the corners 204 of the object 202 and the container 208. In particular, in the depicted embodiment, each of the cushioning devices 206 is located between one of the corners 204 of the object 202 and each of: one of the sides of the container 208, one of the top and bottom of the container 208, the front panel of the container 208, and the back panel of the container 208. After the object 202 and the cushioning devices 206 are inserted into the container 208, the container 208 can be closed by closing the flaps 210.

As can be seen in FIG. 7B, the object 202 can have a contoured surface. In the depicted embodiment, the object 202 is a windshield or a windscreen that has a contoured surface. In other embodiments, the object 202 can be any other type of object that has a contoured surface, such as a curved flatscreen television. As can be seen in FIG. 7B, the slots of the cushioning devices 206 can accommodate the contoured surfaces while still providing cushioning for the respective one of the corners 204 of the object 202.

The package 200 can be used to transport or store the object 202 with the cushioning devices 206 providing cushioning for the corners 204 of the object 202. For example, when the container 208 is closed, a shipping label can be affixed to an outer surface of the container 208 and the object 202 can be shipped in the container 208. In another example, the object 202 can be stored (e.g., in a warehouse) while in the container 208 to provide protection for the object 202 while the object 202 is being stored.

Figure 8:
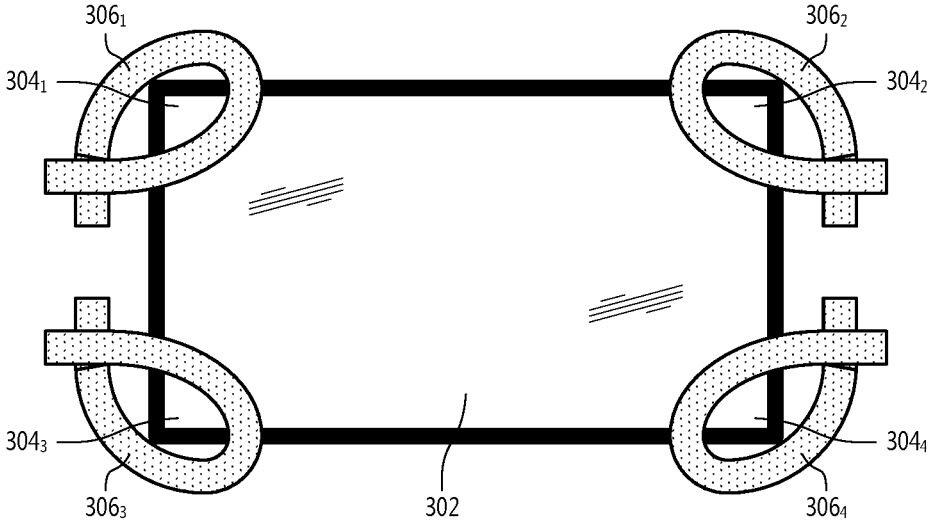
FIG. 8 depicts an embodiment of an object having multiple corners that are cushioned by multiple units of a cushioning device, in accordance with the embodiments disclosed herein.

FIG. 8 depicts an embodiment of an object having multiple corners that are cushioned by multiple units of a cushioning device. In particular, FIG. 8 depicts an object 302 that has corners $\mathbf{304}_1$, $\mathbf{304}_2$, $\mathbf{304}_3$, $\mathbf{304}_4$ (collectively, corners 304). In the depicted embodiment, the object 302 is flatscreen television and none of the corners 304 is a rounded corner. FIG. 8 depicts that each of the corners $\mathbf{304}_1$, $\mathbf{304}_2$, $\mathbf{304}_3$, $\mathbf{304}_4$ is cushioned, respectively, by cushioning devices $\mathbf{306}_1$, $\mathbf{306}_2$, $\mathbf{306}_3$, $\mathbf{306}_4$ (collectively, cushioning devices 306). In some embodiments, each of the cushioning devices 306 is a unit of the cushioning device 100. In some embodiments, each of the cushioning devices 306 is one of the various cushioning devices described herein.

In the depicted embodiment, each of the cushioning devices 306 is in the looped configuration with the first and second coupling mechanisms coupling the first and second ends of the cushioning device. Each of corners 304 of the object 302 has been slid through the slot of one of the cushioning devices 306: the corner $\mathbf{304}_1$ has been slid through the slot of the cushioning device $\mathbf{306}_1$, the corner $\mathbf{304}_2$ has been slid through the slot of the cushioning device $\mathbf{306}_2$, the corner $\mathbf{304}_3$ has been slid through the slot of the cushioning device $\mathbf{306}_3$, and the corner $\mathbf{304}_4$ has been slid through the slot of the cushioning device $\mathbf{306}_4$. In the depicted embodiment, the cushioning devices 306 have been oriented with respect to the object 302 such that the two coupled ends of each of the cushioning devices $\mathbf{306}_1$ and $\mathbf{306}_2$ are located to the sides of the object 302 and the two coupled ends of each of the cushioning devices $\mathbf{306}_3$ and $\mathbf{306}_4$ are located below the bottom of the object 302.

Figure 9A:
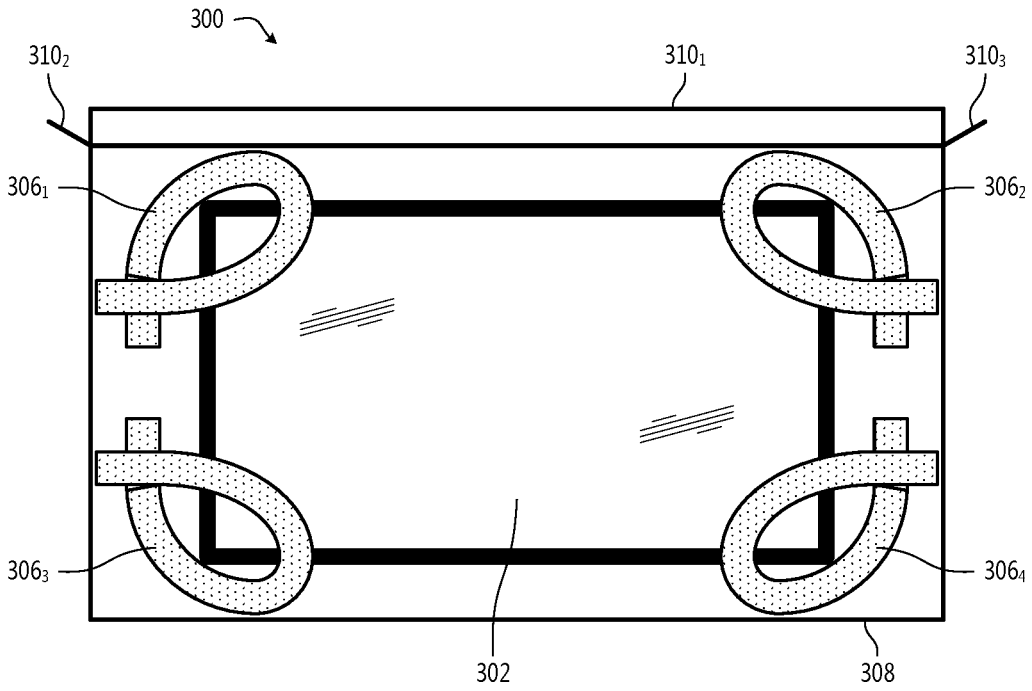
FIGS. 9A and 9B depict, respectively, front and top views of a package that includes the object and the cushioning devices shown in FIG. 8, in accordance with the embodiments disclosed herein.
Figure 9B:
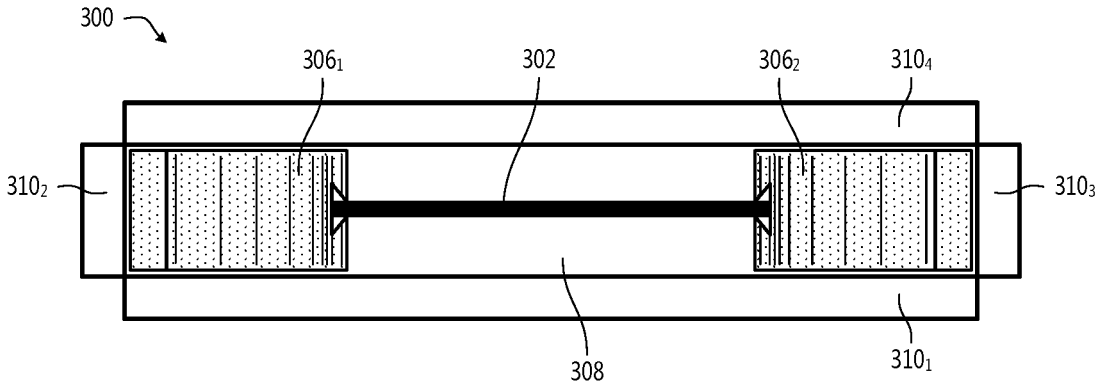

The object 302 and the cushioning devices 306 can be inserted into a container to form a package. FIGS. 9A and 9B depict, respectively, front and top views of a package 300 that includes the object 302 and the cushioning devices 306. The package 300 includes a container 308. The container is shown in FIGS. 9A and 9B as being transparent for ease in viewing the object 302 and the cushioning devices 306. In other embodiments, the container 308 can be opaque or translucent. For example, the container 308 can be a shipping container (e.g., a cardboard box), storage bin (e.g., a plastic storage bin), or any other type of container. In the depicted embodiment, the bottom of the container 308 is closed and the top of the container 308 is open. The container 308 includes flaps $\mathbf{310}_1$, $\mathbf{310}_2$, $\mathbf{310}_3$, $\mathbf{310}_4$ (collectively, flaps 310) that are shown as being open in FIGS. 9A and 9B.

When the flaps 310 are open, the object 302 and the cushioning devices 306 can be inserted into the container 308 until the object 302 and the cushioning devices 306 are in the positions shown in FIGS. 9A and 9B. In the arrangement shown in FIGS. 9A and 9B, each of the cushioning devices 306 is located between one of the corners 304 of the object 302 and the container 308. In particular, in the depicted embodiment, each of the cushioning devices 306 is located between one of the corners 304 of the object 302 and each of: one of the sides of the container 308, one of the top and bottom of the container 308, the front panel of the container 308, and the back panel of the container 308. After the object 302 and the cushioning devices 306 are inserted into the container 308, the container 308 can be closed by closing the flaps 310.

As can be seen in FIG. 9B, the object 302 has substantially planar surfaces. In the depicted embodiment, the object 302 is a flatscreen television that has substantially planar surfaces. In other embodiments, the object 302 can be any other type of object that has substantially planar surfaces. As can be seen in FIG. 9B, the slots of the cushioning devices 306 can accommodate the substantially planar surfaces while still providing cushioning for the respective one of the corners 304 of the object 302.

The package 300 can be used to transport or store the object 302 with the cushioning devices 306 providing cushioning for the corners 304 of the object 302. For example, when the container 308 is closed, a shipping label can be affixed to an outer surface of the container 308 and the object 302 can be shipped in the container 308. In another example, the object 302 can be stored (e.g., in a warehouse) while in the container 308 to provide protection for the object 302 while the object 302 is being stored.

As noted above, the cushioning device 100 can be varied in a number of ways and still provide cushioning for the side or the corner of an object in similar ways to the cushioning device 100. FIGS. 10A to 10F depict examples of variations of the cushioning device 100 in accordance with the embodiments disclosed herein. In particular, FIGS. 10A to 10F depict cushioning devices $\mathbf{100}_1$, $\mathbf{100}_2$, $\mathbf{100}_3$, $\mathbf{100}_4$, $\mathbf{100}_5$, $\mathbf{100}_6$, respectively. The features of the cushioning devices $\mathbf{100}_1$, $\mathbf{100}_2$, $\mathbf{100}_3$, $\mathbf{100}_4$, $\mathbf{100}_5$, $\mathbf{100}_6$ that are numbered the same as the cushioning device 100 are similar to or the same as the respective features in the cushioning device 100.

The cushioning devices $\mathbf{100}_1$, $\mathbf{100}_2$, $\mathbf{100}_3$, $\mathbf{100}_4$, $\mathbf{100}_5$ have slots $\mathbf{116}_1$, $\mathbf{116}_2$, $\mathbf{116}_3$, $\mathbf{116}_4$, $\mathbf{116}_5$, respectively, instead of the slot 116 shown in the cushioning device 100. The slots $\mathbf{116}_1$, $\mathbf{116}_2$, $\mathbf{116}_3$, $\mathbf{116}_4$, $\mathbf{116}_5$ are positioned in the cushioning devices $\mathbf{100}_1$, $\mathbf{100}_2$, $\mathbf{100}_3$, $\mathbf{100}_4$, $\mathbf{100}_5$, respectively, similar to the positioning of the slot 116 in the cushioning device 100. Instead of the sawtooth wave shape of the sides of the slot 116, the sides of the slots $\mathbf{116}_1$, $\mathbf{116}_2$, $\mathbf{116}_3$, $\mathbf{116}_4$, $\mathbf{116}_5$ have different shapes. The slot $\mathbf{116}_1$ of the cushioning device $\mathbf{100}_1$ in FIG. 10A has sides with a sine wave shape. The slot $\mathbf{116}_2$ of the cushioning device $\mathbf{100}_2$ in FIG. 10B has sides with a convex shape. The slot $\mathbf{116}_3$ of the cushioning device $\mathbf{100}_3$ in FIG. 10C has sides that are straight. The slot $\mathbf{116}_4$ of the cushioning device $\mathbf{100}_4$ in FIG. 10D has sides with a square wave shape. The slot $\mathbf{116}_5$ of the cushioning device $\mathbf{100}_5$ in FIG. 10E has sides with semicircular shapes. The sides of the slot of a cushioning device can have any other type of shape. In some embodiments, the shape of the sides of the slot in a cushioning device is selected based on the desired gripping function of the slot on the object that will be slid therethrough.

Figure 10A:
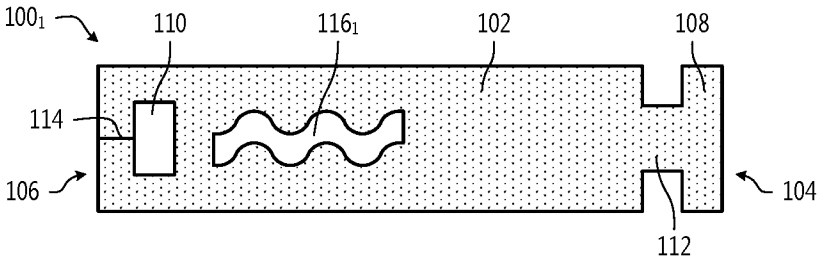
FIGS. 10A to 10F depict examples of variations of the cushioning device shown in FIGS. 1A and 1B, in accordance with the embodiments disclosed herein.
Figure 10B:
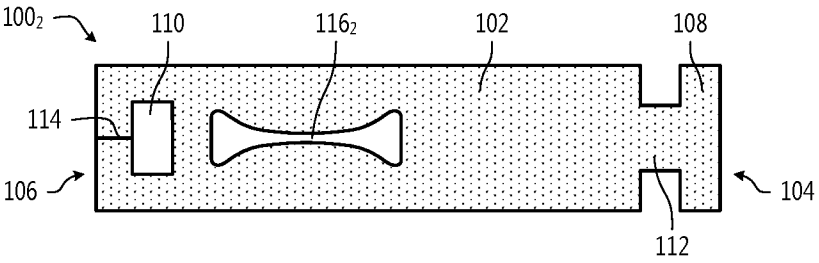
Figure 10C:
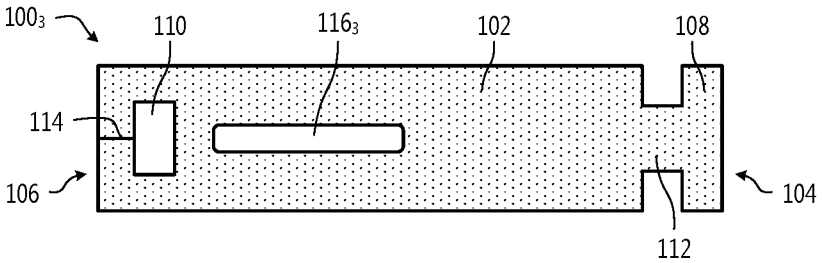
Figure 10D:
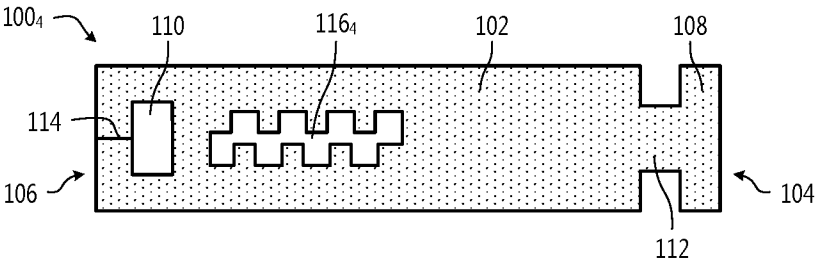
Figure 10E:
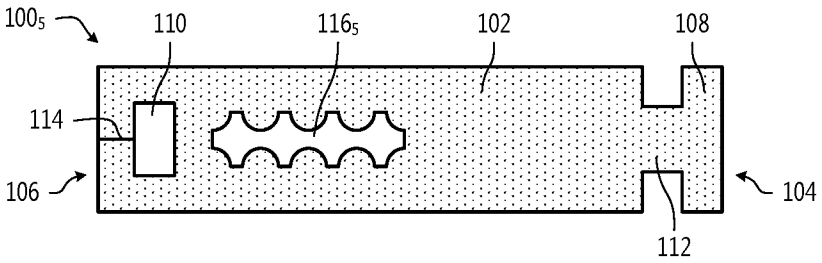
Figure 10F:
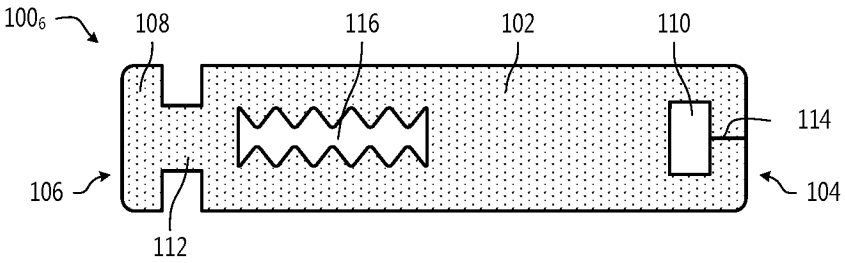

In the embodiments shown above, the slot is shown proximate the second end and the second coupling device. In will be understood that, in other embodiments, the first and second ends are interchangeable and that the first and second coupling devices are interchangeable. The cushioning device $\mathbf{100}_6$ depicted in FIG. 10F shows one of these variations of the cushioning device 100.

In the cushioning device $\mathbf{100}_6$, the first coupling mechanism 108, including the neck 112, is located proximate the second end 106 and the slot 116. The second coupling mechanism 110 and the slit 114 are located proximate the first end 104. Despite the first and second coupling mechanisms 108 and 110 being interchanged from their positions in the cushioning device 100, the cushioning device $\mathbf{100}_6$ can be bent from the flat configuration shown in FIG. 10F to the looped configuration where the first and second coupling mechanisms are can be coupled to each other to hold the cushioning device $\mathbf{100}_6$ in the looped configuration. It will be understood that the first and second ends can be interchanged and/or the first and second coupling mechanisms can be interchanged on any of the embodiments of cushioning devices described herein.

The cushioning device $\mathbf{100}_6$ also depicts another variation. The corners of the unitary body 102 in the cushioning device $\mathbf{100}_6$ are rounded. It will be understood that the rounded corners of the unitary body 102 in the cushioning device $\mathbf{100}_6$ would not affect the functions of the cushioning device $\mathbf{100}_6$. It will be further understood that the unitary body of any of the embodiments of cushioning devices described herein could have rounded corners or any other similar variation in shape or size.

Figure 11A:
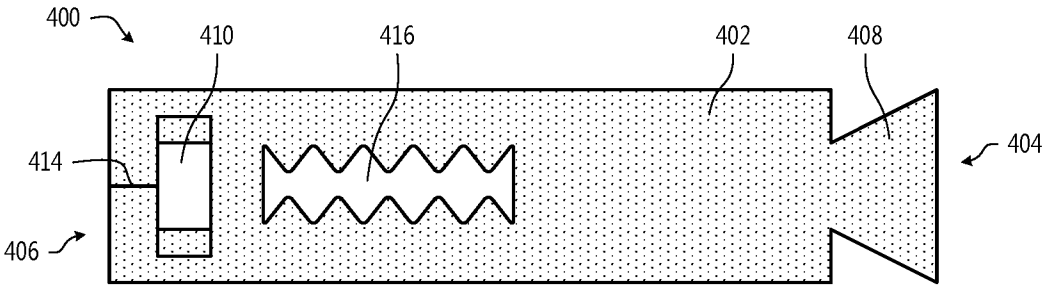
FIGS. 11A, 11B, and 11C depict top, side, and cross-sectional end views, respectively, of a cushioning device that includes a unitary body, in accordance with the embodiments disclosed herein.
Figure 11B:
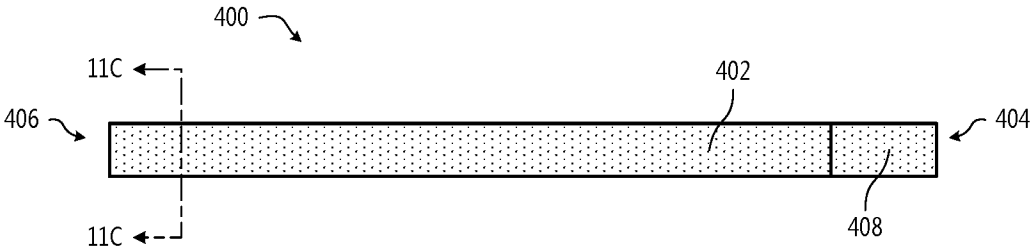
Figure 11C:
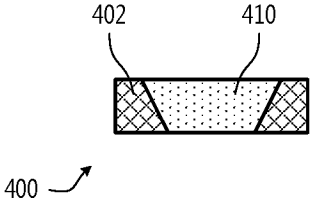

Similar to the possible variations in the shape of the slots and other variations of the cushioning devices described above, any type of coupling mechanisms can be used. FIGS. 11A to 16C depict examples of first and second coupling devices that can be used with cushioning devices. FIGS. 11A, 11B, and 11C depict top, side, and cross-sectional end views, respectively, of a cushioning device 400. The cushioning device 400 has a unitary body 402 that can be made from a resilient material. The unitary body 402 has a length, a width, and a thickness, where the length is greater than the width. The unitary body 402 has first and second ends 404 and 406 that are located opposite each other in a direction of the length of the unitary body 402. The unitary body 402 has first and second coupling mechanisms 408 and 410 located on the first and second ends 404 and 406, respectively, of the unitary body 402. The unitary body 402 has a slot 416 through the thickness of the unitary body 402.

In the depicted embodiment, the first coupling mechanism 408 has a trapezoidal shape. As can be seen in FIGS. 11A and 11C, the second coupling mechanism 410 has a through hole with a slit 414. As can be seen in FIG. 11C, the through hole of the second coupling mechanism 410 has a graduated shape. When the unitary body 402 is in a looped configuration, the first and second coupling mechanisms 408 and 410 are configured to be coupled to each other to hold the unitary body 402 in the looped configuration.

Figure 12A:
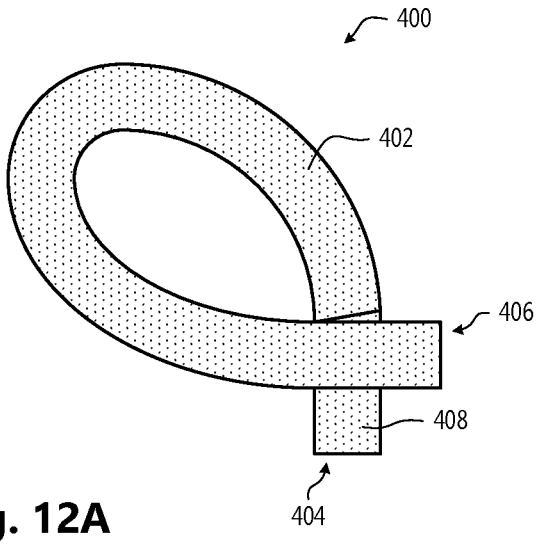
FIGS. 12A and 12B depict front and side views, respectively, of the unitary body of the cushioning device shown in FIGS. 11A, 11B, and 11C in the looped configuration, in accordance with the embodiments disclosed herein.
Figure 12B:
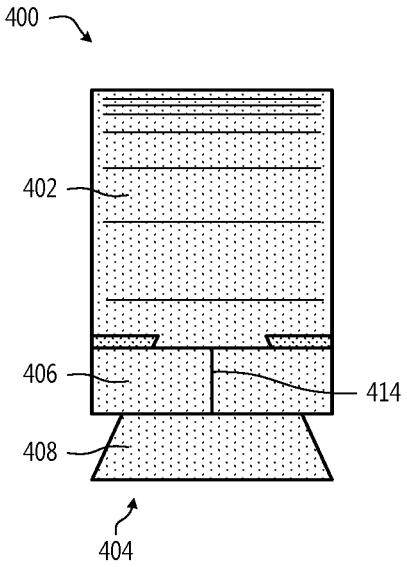

FIGS. 12A and 12B depict front and side views, respectively, of the unitary body 402 of the cushioning device 400 in the looped configuration. When the unitary body 402 is in the looped configuration, the slot 416 is capable of having a side or a corner of an object slid therethrough so that the unitary body 402 in the looped configuration provides cushioning for the side or the corner of the object. As can be seen particularly in FIG. 12B, when the first and second coupling mechanisms 408 and 410 are coupled to each other, the trapezoidal shape of the first coupling mechanism 408 seats against the graduated shape in the through hole of the second coupling mechanism 410.

Figure 13A:
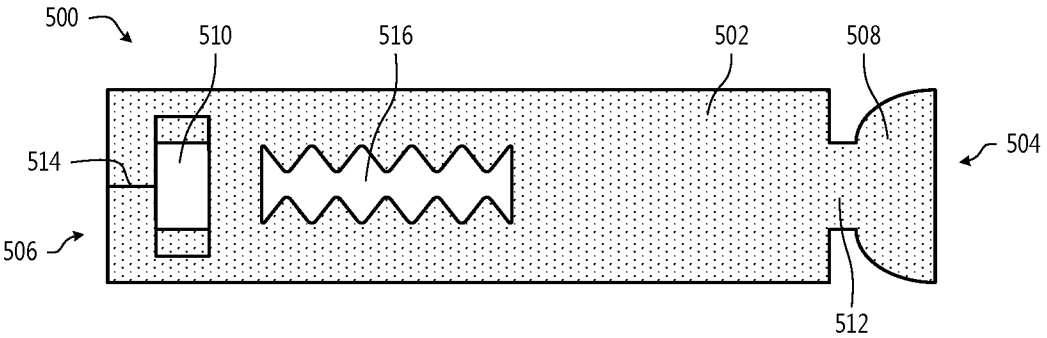
FIGS. 13A, 13B, and 13C depict top, side, and cross-sectional end views, respectively, of a cushioning device that includes a unitary body, in accordance with the embodiments disclosed herein.
Figure 13B:
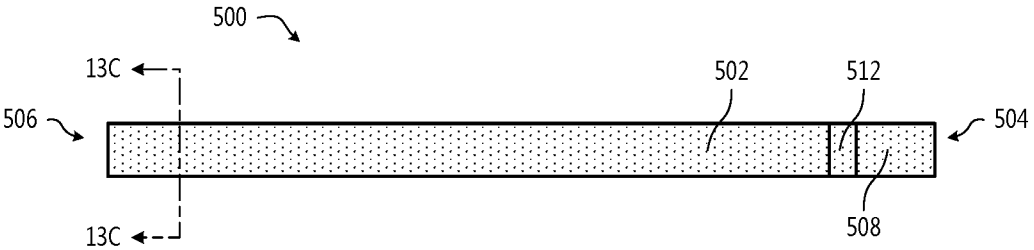
Figure 13C:
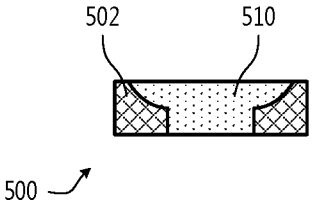

FIGS. 13A, 13B, and 13C depict top, side, and cross-sectional end views, respectively, of a cushioning device 500. The cushioning device 500 has a unitary body 502 that can be made from a resilient material. The unitary body 502 has a length, a width, and a thickness, where the length is greater than the width. The unitary body 502 has first and second ends 504 and 506 that are located opposite each other in a direction of the length of the unitary body 502. The unitary body 502 has first and second coupling mechanisms 508 and 510 located on the first and second ends 504 and 506, respectively, of the unitary body 502. The unitary body 502 has a slot 516 through the thickness of the unitary body 502.

In the depicted embodiment, the first coupling mechanism 508 has a convex arcuate shape and a neck 512. As can be seen in FIGS. 13A and 13C, the second coupling mechanism 510 has a through hole with a slit 514. As can be seen in FIG. 13C, the through hole of the second coupling mechanism 510 has a concave arcuate shape. When the unitary body 502 is in a looped configuration, the first and second coupling mechanisms 508 and 510 are configured to be coupled to each other to hold the unitary body 502 in the looped configuration.

Figure 14A:
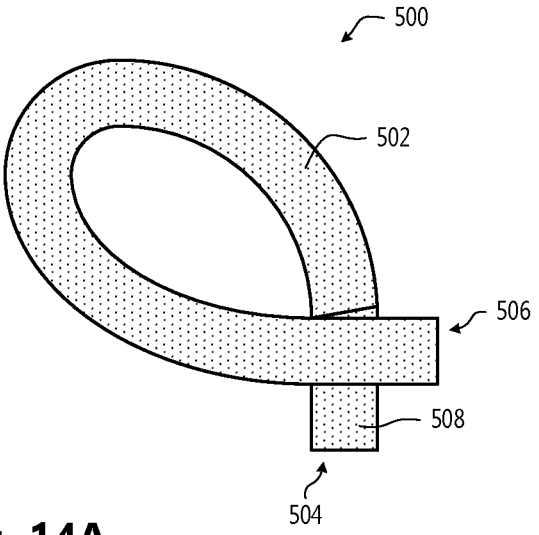
FIGS. 14A and 14B depict front and side views, respectively, of the unitary body of the cushioning device shown in FIGS. 13A, 13B, and 13C in the looped configuration, in accordance with the embodiments disclosed herein.
Figure 14B:
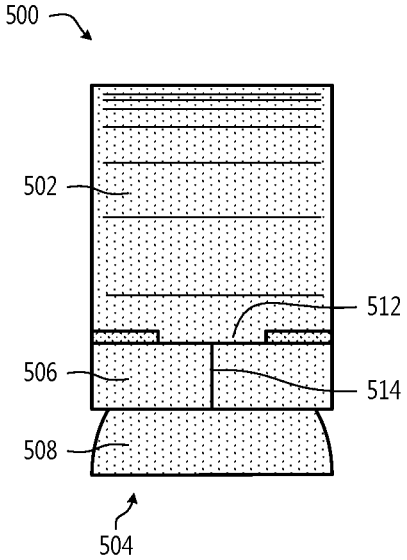

FIGS. 14A and 14B depict front and side views, respectively, of the unitary body 502 of the cushioning device 500 in the looped configuration. When the unitary body 502 is in the looped configuration, the slot 516 is capable of having a side or a corner of an object slid therethrough so that the unitary body 502 in the looped configuration provides cushioning for the side or the corner of the object. As can be seen particularly in FIG. 14B, when the first and second coupling mechanisms 508 and 510 are coupled to each other, the convex arcuate shape of the first coupling mechanism 508 seats against the concave arcuate shape in the through hole of the second coupling mechanism 510.

Figure 15A:
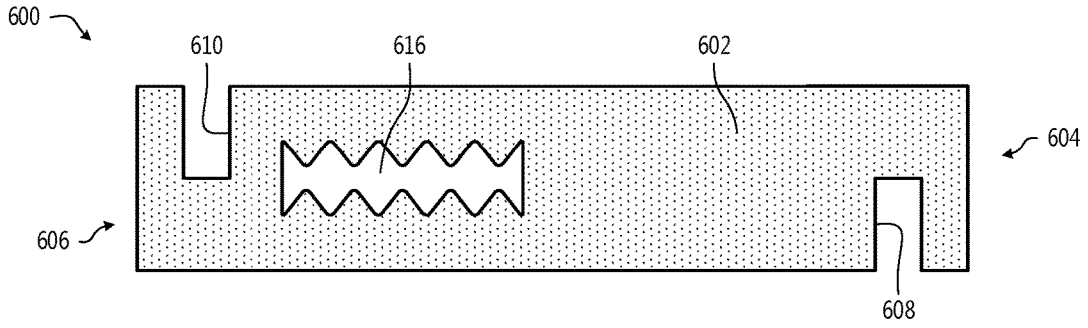
FIGS. 15A and 15B depict top and side views, respectively, of a cushioning device that has a unitary body, in accordance with the embodiments disclosed herein.
Figure 15B:
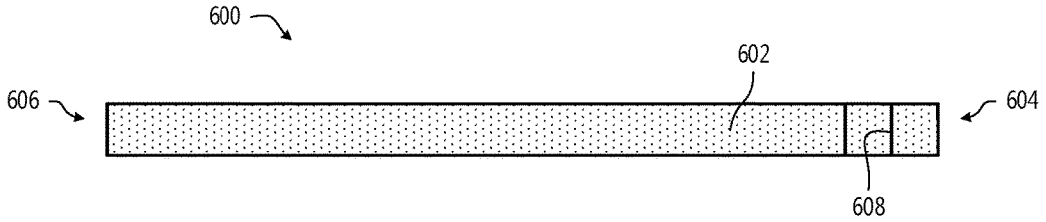

FIGS. 15A and 15B depict top and side views, respectively, of a cushioning device 600. The cushioning device 600 has a unitary body 602 that can be made from a resilient material. The unitary body 602 has a length, a width, and a thickness, where the length is greater than the width. The unitary body 602 has first and second ends 604 and 606 that are located opposite each other in a direction of the length of the unitary body 602. The unitary body 602 has first and second coupling mechanisms 608 and 610 located on the first and second ends 604 and 606, respectively, of the unitary body 602. The unitary body 602 has a slot 616 through the thickness of the unitary body 602.

In the depicted embodiment, the first coupling mechanism 608 has a side slot and the second coupling mechanism 610 has a side slot. In the depicted embodiment, the side slot of the first coupling mechanism 608 is on an opposite side of the unitary body 602 in the width direction than the side slot of the second coupling mechanism 610. When the unitary body 602 is in a looped configuration, the first and second coupling mechanisms 608 and 610 are configured to be coupled to each other to hold the unitary body 602 in the looped configuration.

Figure 16A:
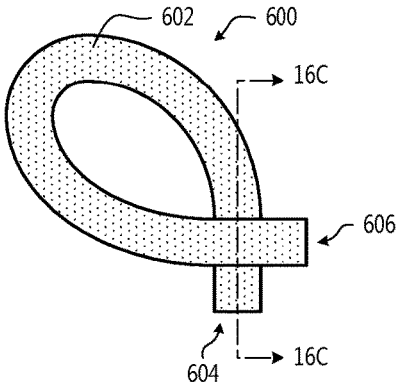
FIGS. 16A, 16B, and 16C depict front, side, and cross-sectional front views, respectively, of the unitary body of the cushioning device shown in FIGS. 15A and 15B in the looped configuration, in accordance with the embodiments disclosed herein.
Figure 16B:
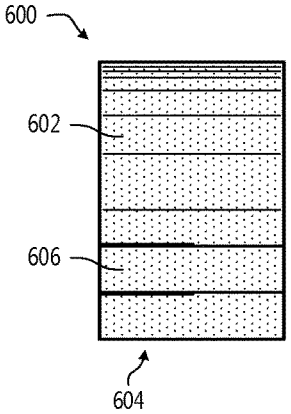
Figure 16C:
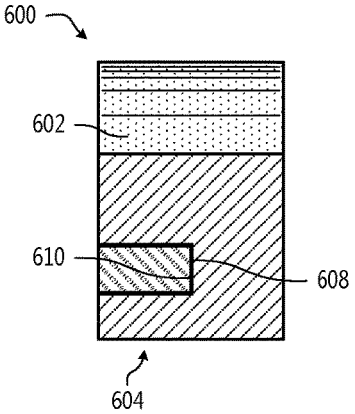

FIGS. 16A, 16B, and 16C depict front, side, and cross-sectional front views, respectively, of the unitary body 602 of the cushioning device 600 in the looped configuration. When the unitary body 602 is in the looped configuration, the slot 616 is capable of having a side or a corner of an object slid therethrough so that the unitary body 602 in the looped configuration provides cushioning for the side or the corner of the object. As can be seen particularly in FIG. 16C, when the first and second coupling mechanisms 608 and 610 are coupled to each other, the side slot of the first coupling mechanism 608 and the side slot of the hole of the second coupling mechanism 610 engage each other to hold the unitary body 602 in the looped configuration.

It will be understood that there are other types and shapes of coupling mechanisms that can be used in a cushioning device to hold the unitary body of the cushioning device in a looped configuration. It will be appreciated that no particular shape and/or size of the coupling mechanisms is essential so long as the coupling mechanisms are capable of holding the unitary body of the cushioning device in a looped configuration.

Figure 17A:
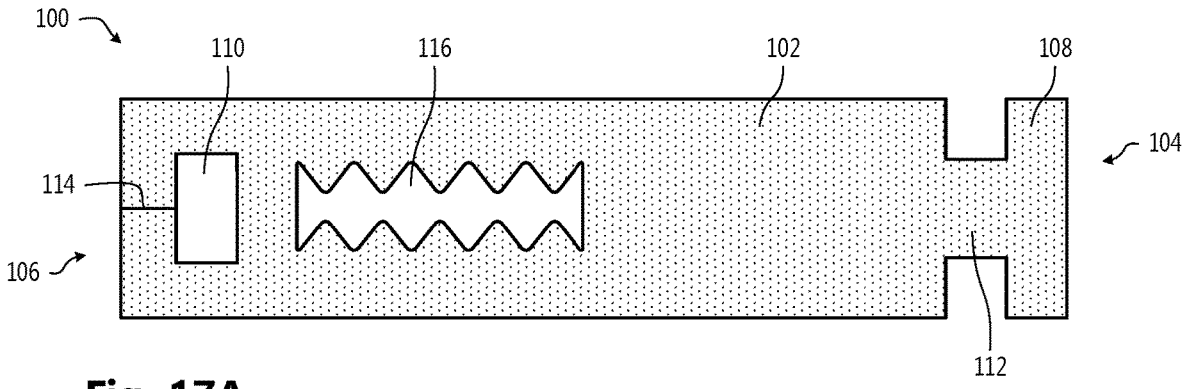
FIGS. 17A, 17B, and 17C depict front views of three different sizes of cushioning devices, in accordance with the embodiments disclosed herein.
Figure 17B:
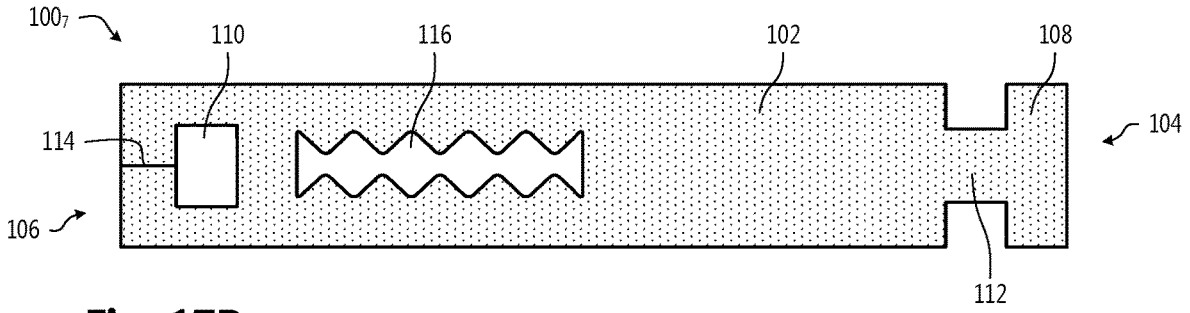
Figure 17C:
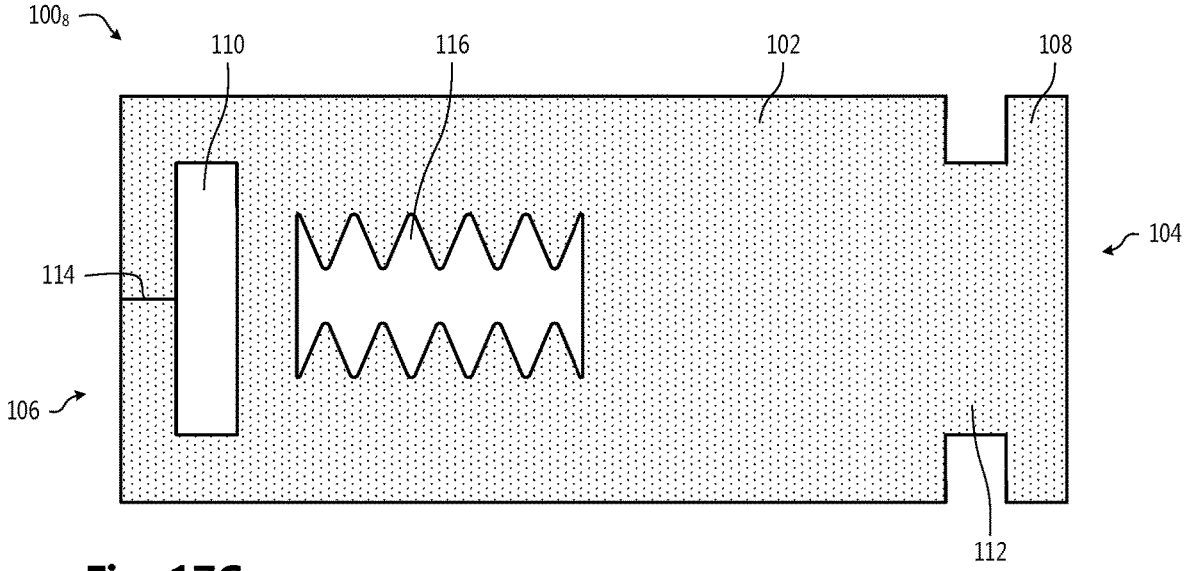

It will also be understood that the size of the unitary body and coupling devices can be varied while still performing the functions of cushioning devices described herein. FIGS. 17A, 17B, and 17C depict front views of three different sizes of cushioning devices in accordance with the embodiment disclosed herein. In particular, FIG. 17A depicts the cushioning device 100 that is also shown in FIG. 1A. FIGS. 17B and 17C depict cushioning device $\mathbf{100}_7$ and $\mathbf{100}_8$, respectively, that are variations in size of the cushioning device 100. The cushioning device $\mathbf{100}_7$ has a length-to-width ratio that is greater than the length-to-width ratio of the cushioning device 100. The cushioning device $\mathbf{100}_8$ has a length-to-width ratio that is less than the length-to-width ratio of the cushioning device 100. In each of the cushioning devices 100, $\mathbf{100}_7$, and $\mathbf{100}_8$ the length is greater than the width. It will be apparent that each of the cushioning devices 100, $\mathbf{100}_7$, and $\mathbf{100}_8$ is capable of providing cushioning for a side or a corner of an object, as described herein, despite the differences in the length-to-width ratios.

Figure 18A:
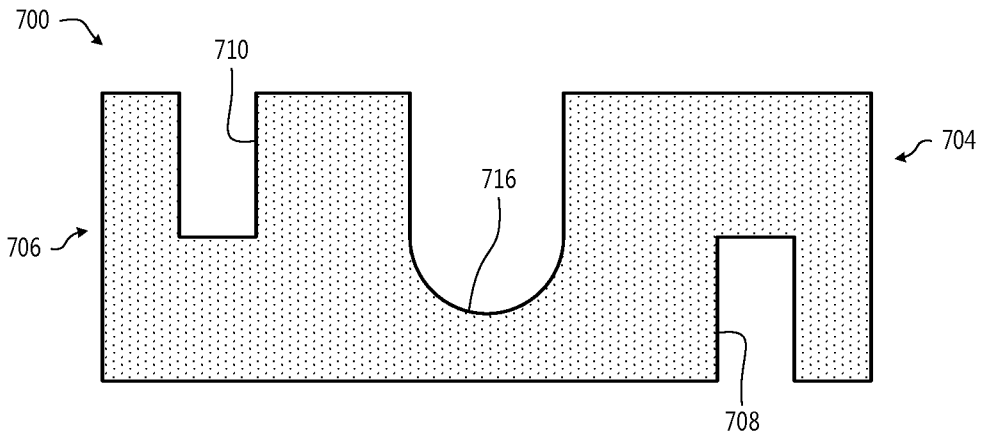
FIG. 18A depicts a top view of an embodiment of a cushioning device, in accordance with the embodiments disclosed herein.

FIG. 18A depicts a top view of an embodiment of a cushioning device 700. The cushioning device 700 has a unitary body 702 that can be made from a resilient material. The unitary body 702 has a length, a width, and a thickness, where the length is greater than the width. The unitary body 702 has first and second ends 704 and 706 that are located opposite each other in a direction of the length of the unitary body 702. The unitary body 702 has first and second coupling mechanisms 708 and 710 located on the first and second ends 704 and 706, respectively, of the unitary body 702. The unitary body 702 has a slot 716 through the thickness of the unitary body 702. In the depicted embodiment, the slot 716 extends from one of the long sides of the unitary body 702.

In the depicted embodiment, the first coupling mechanism 708 has a side slot and the second coupling mechanism 710 has a side slot. In the depicted embodiment, the side slot of the first coupling mechanism 708 is on an opposite side of the unitary body 702 in the width direction than the side slot of the second coupling mechanism 710. When the unitary body 702 is in a looped configuration, the first and second coupling mechanisms 708 and 710 are configured to be coupled to each other to hold the unitary body 702 in the looped configuration. The cushioning device 700 can be looped such that the first and second coupling mechanisms 708 and 710 are coupled to each other when the unitary body 702 is in a looped configuration to hold the unitary body 702 in the looped configuration.

Figure 18B:
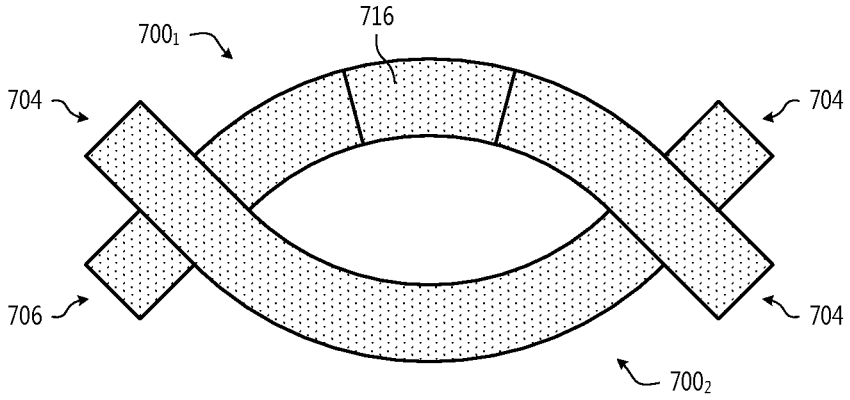
FIG. 18B depicts a top view of an embodiment of a system that includes two cushioning devices shown in FIG. 18A that are held together in a looped configuration, in accordance with the embodiments disclosed herein.

FIG. 18B depicts a top view of an embodiment of a system that includes two cushioning devices $\mathbf{700}_1$ and $\mathbf{700}_2$ that are held together in a looped configuration. Each of the cushioning devices $\mathbf{700}_1$ and $\mathbf{700}_2$ has the shape and features of the cushioning device 700. The cushioning device $\mathbf{700}_1$ is oriented with the slot 716 facing upward and the cushioning device $\mathbf{700}_2$ is oriented with the slot 716 facing downward. The first coupling mechanism 708 of the cushioning device $\mathbf{700}_2$ is coupled to the second coupling mechanism 710 of the cushioning device $\mathbf{700}_1$ and the second coupling mechanism 710 of the cushioning device $\mathbf{700}_2$ is coupled to the first coupling mechanism 708 of the cushioning device $\mathbf{700}_1$. The coupling mechanisms 708 and 710 of the cushioning devices $\mathbf{700}_1$ and $\mathbf{700}_2$ are configured to hold the cushioning devices $\mathbf{700}_1$ and $\mathbf{700}_2$ in the looped configurations shown.

Figure 18C:
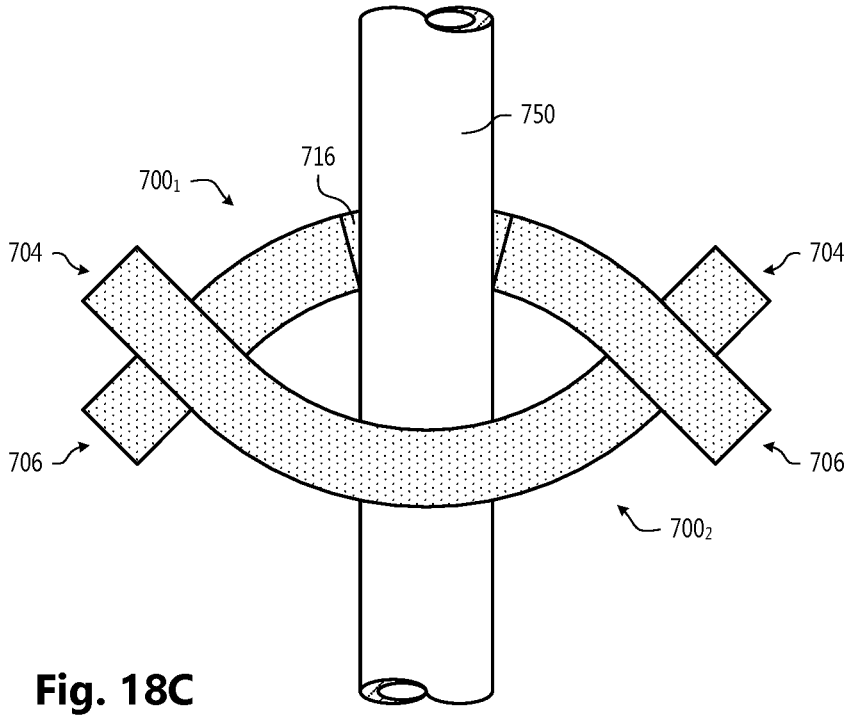
FIGS. 18C and 18D show top and side views of an embodiment of the system shown in FIG. 18B being used to cushion an object, in accordance with the embodiments disclosed herein.
Figure 18D:
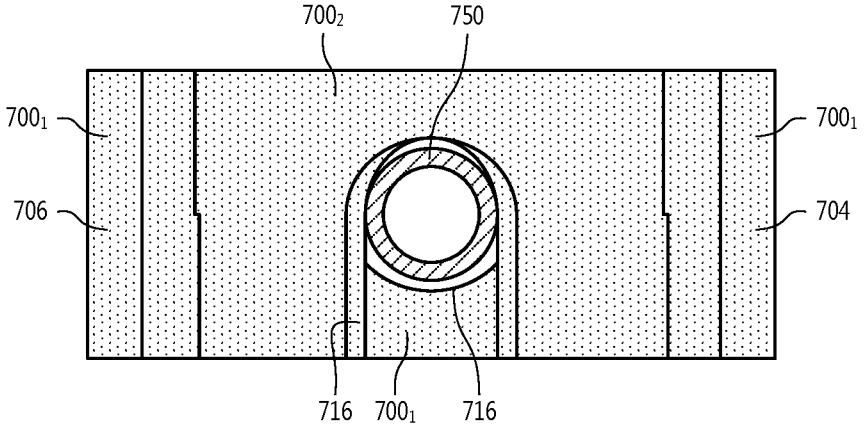

FIGS. 18C and 18D show top and side views of an embodiment of the system of the cushioning devices $\mathbf{700}_1$ and $\mathbf{700}_2$ shown in FIG. 18B being used to cushion an object 750. In the depicted embodiment, the object 750 is a pipe. The object 750 could be any other kind of elongated object, such as a portion of a bicycle frame. The object 750 has been placed in the system of the cushioning devices $\mathbf{700}_1$ and $\mathbf{700}_2$ with the object 750 passing through the slots 716 of the cushioning devices $\mathbf{700}_1$ and $\mathbf{700}_2$. In the depicted embodiment, the sides of the slots 716 contact the object 750 to hold the relative positions of the cushioning devices $\mathbf{700}_1$ and $\mathbf{700}_2$ and the object 750. Also, the slots 716 of the cushioning devices $\mathbf{700}_1$ and $\mathbf{700}_2$ are oriented such that the closed ends of the slots 716 contact opposite sides of the object 750.

Figure 19A:
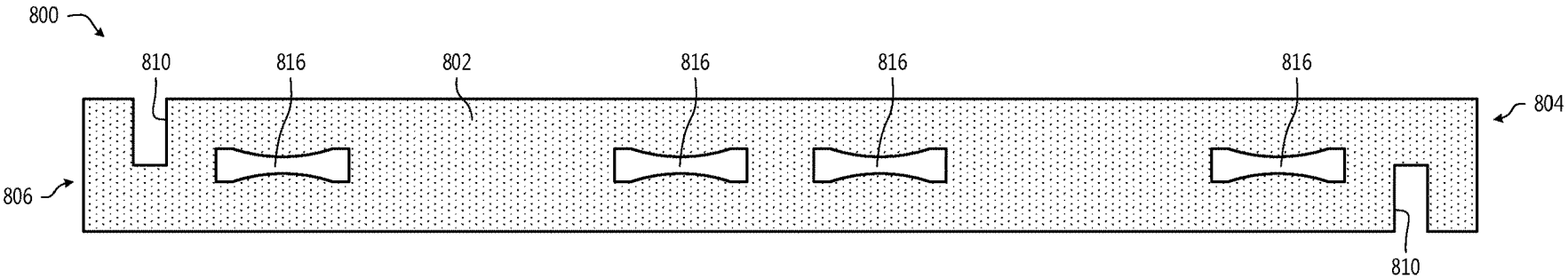
FIG. 19A depicts a top view of an embodiment of a cushioning device, in accordance with the embodiments disclosed herein.

FIG. 19A depicts a top view of an embodiment of a cushioning device 800. The cushioning device 800 has a unitary body 802 that can be made from a resilient material. The unitary body 802 has a length, a width, and a thickness, where the length is greater than the width. The unitary body 802 has first and second ends 804 and 806 that are located opposite each other in a direction of the length of the unitary body 802. The unitary body 802 has first and second coupling mechanisms 808 and 810 located on the first and second ends 804 and 806, respectively, of the unitary body 802. The unitary body 802 has slots 816 through the thickness of the unitary body 802. In the depicted embodiment, the slots 816 include four slots that are substantially centered on the unitary body 802 in the width direction and are spaced at varying intervals in the length direction of the unitary body 802.

In the depicted embodiment, the first coupling mechanism 808 has a side slot and the second coupling mechanism 810 has a side slot. In the depicted embodiment, the side slot of the first coupling mechanism 808 is on an opposite side of the unitary body 802 in the width direction than the side slot of the second coupling mechanism 810. When the unitary body 802 is in a looped configuration, the first and second coupling mechanisms 808 and 810 are configured to be coupled to each other to hold the unitary body 802 in the looped configuration. The cushioning device 800 can be looped such that the first and second coupling mechanisms 808 and 810 are coupled to each other when the unitary body 802 is in a looped configuration to hold the unitary body 802 in the looped configuration.

Figure 19B:
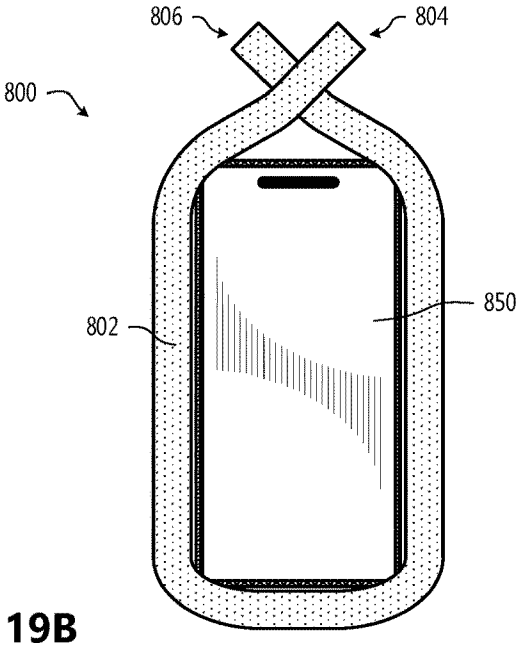
FIGS. 19B and 19C depict front and side views of an embodiment of a system that includes the cushioning device shown in FIG. 19A in a looped configuration around an object, in accordance with the embodiments disclosed herein.
Figure 19C:
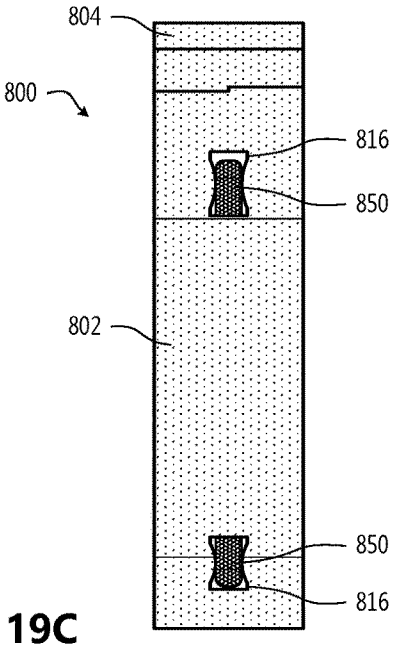

FIGS. 19B and 19C depict front and side views of an embodiment of a system that includes the cushioning device 800 in a looped configuration around an object 850. In the depicted embodiment, the object 850 is a cell phone. In other embodiments, the object 850 could be any object that is generally rectangular in shape, such as tablets, televisions, computer monitors, mirrors, frames, and the like. In other embodiments, the object 850 could be any other type or shape of object. In the depicted embodiment, the cushioning device 800 is in a looped configuration with the first and second coupling mechanisms 808 and 810 being coupled to each other to hold the unitary body 802 in the looped configuration. The cushioning device 800 is looped around the object 850 and the object 850 is positioned such that each of the corners of the object 850 is located in one of the slots 816 of the cushioning device 800. The location of the corners of the object 850 in the slots 816 deter relative movement of the object 850 with respect to the cushioning device 800 so that the object 850 is securely held inside of the unitary body 802 of the cushioning device 800.

Figure 20A:
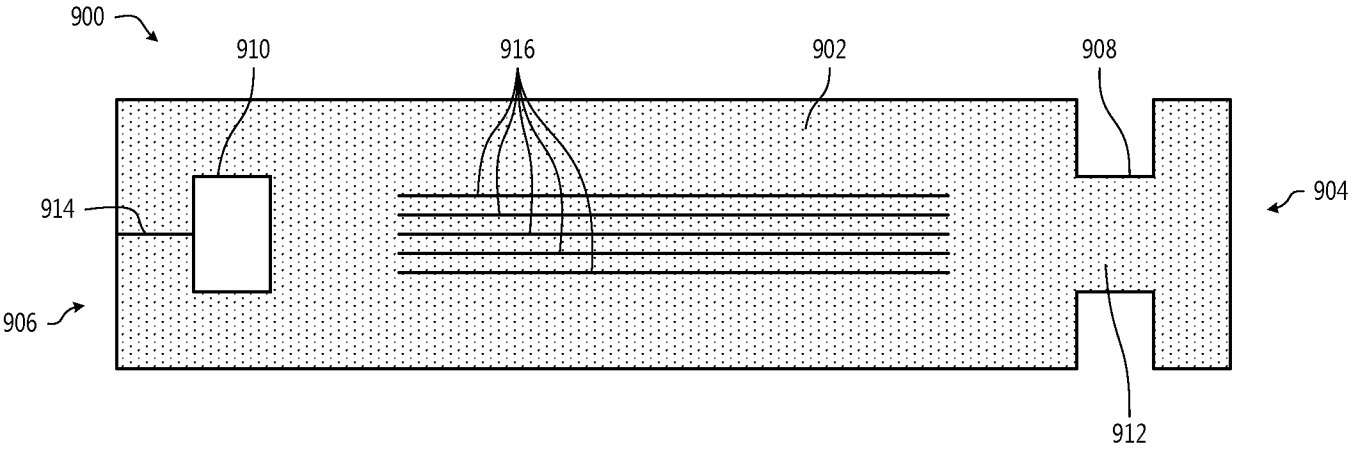
FIGS. 20A and 20B depict front and side views, respectively, of an embodiment of a cushioning device, in accordance with the embodiments disclosed herein.
Figure 20B:
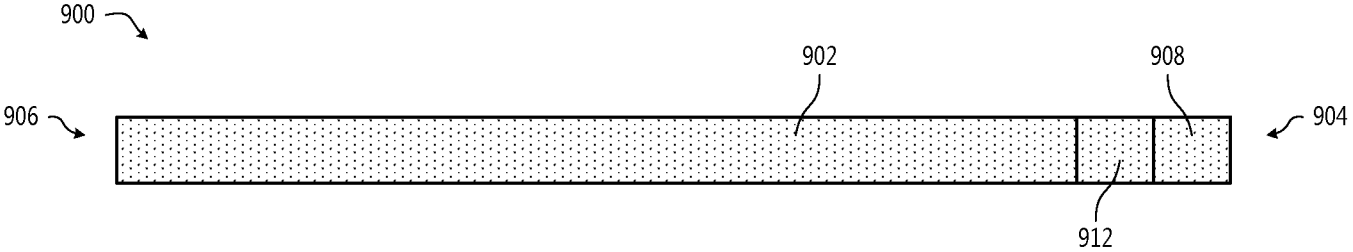

FIGS. 20A and 20B depict front and side views, respectively, of an embodiment of a cushioning device 900. The cushioning device 900 includes a unitary body 902. In the depicted embodiment, the unitary body 902 has a length, a width, and a thickness, where the length of the unitary body 902 is greater than the width of the unitary body 902. The unitary body 902 of the cushioning device 900 includes a first end 904 and a second end 906. The first and second ends 904 and 906 are located opposite each other in a direction of the length of the unitary body 902.

The unitary body 902 includes a first coupling mechanism 908 and a second coupling mechanism 910. The unitary body 902 can be bent into a looped configuration. When the unitary body 902 is in the looped configuration, the first and second coupling mechanisms 908 and 910 are configured to be coupled to each other to hold the unitary body 902 in the looped configuration. In the depicted embodiment, the first coupling mechanism 908 has a hammerhead shape that includes a neck 912. The second coupling mechanism 910 has through hole. In the depicted embodiment, the through hole of the second coupling mechanism 910 has a width that is equal to or greater than a width of the neck 912. In this way, when the first and second coupling mechanisms 908 and 910 are coupled to each other, the neck 912 of the first coupling mechanism 908 passes through the through hole of the second coupling mechanism 910. In the depicted embodiment, the through hole of the second coupling mechanism 910 is located proximate the second end 906 of the unitary body 902 and the unitary body 902 further includes a slit 914 between the through hole and the second end 906. To couple the first and second coupling mechanisms 908 and 910, portions of the unitary body 902 on either side of the slit 914 can be pulled apart such that the neck 912 can be slide though the second end 906 and into the through hole of the second coupling mechanism 910. Other embodiments of the first and second coupling mechanisms 908 and 910 and be used in place of the embodiment shown in FIGS. 20A and 20B.

The unitary body 902 of the cushioning device 900 also includes slots 916. When the unitary body 902 is in the looped configuration, the slots 916 are capable of having a side or a corner of an object slid therethrough so that the unitary body 902 in the looped configuration provides cushioning for the side or the corner of the object. In the depicted embodiment, the slots 916 include a plurality of slits that extend in the length direction. In some embodiments, the slots 916 are substantially centered on the unitary body 902 in the width direction. In the depicted embodiment, the slots 916 are substantially centered between the through hole of the second coupling mechanism 910 and the neck 912 of the first coupling mechanism 908.

In the embodiments where the slots 916 are slits, the slots 916 can hold the corner of relatively thin objects. For example, the cushioning device 900 can be used in place of each of the cushioning devices 206 in FIGS. 6 to 7B and the cushioning device 900 can be used in place of each of the cushioning devices 306 in FIGS. 8 to 9B. In those embodiments, each of the corners 204 of the object 202 or the corners 304 of the object 302 can be slid through one of the slots 916 of the cushioning device 900. In the particular embodiment shown in FIGS. 6 to 7B, where the object 202 is a windshield, the object 202 is non-planar. The inclusion of multiple slots 916 in each of the cushioning devices 900 allows the different corners 204 of the object 204 to be slid into any of the slots 916 that would best accommodate the non-planar shape of the object 202.

Figure 21A:
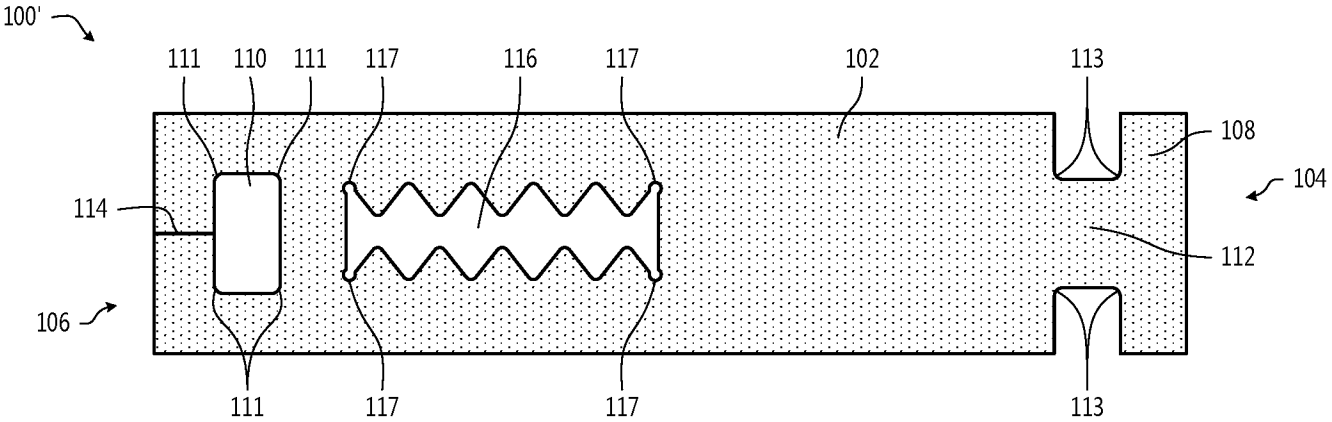
FIGS. 21A and 21B depict front and side views, respectively, of an embodiment of a cushioning device that is a variation of the cushioning device shown in FIGS. 1A and 1B, in accordance with the embodiments disclosed herein.
Figure 21B:
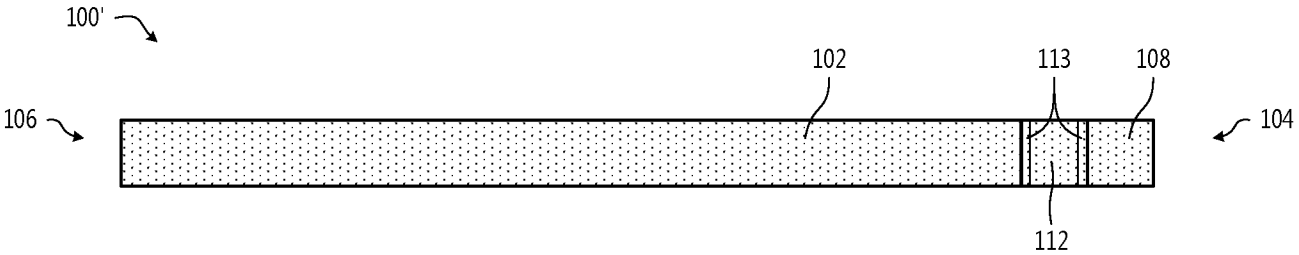

FIGS. 21A and 21B depict front and side views, respectively, of an embodiment of a cushioning device 100' that is a variation of the cushioning device 100 shown in FIGS. 1A and 1B. The cushioning device 100' is similar to the cushioning device 100 in that the cushioning device 100' includes the unitary body 102, the first and second ends 104 and 106, the first and second coupling mechanisms 108 and 110, the neck 112, the slit 114, and the slot 116. Similarly, the unitary body 102 of the cushioning device 100' can be made of a material that is any of the materials described above for the unitary body 102 of the cushioning device 100, such as a resilient material (e.g., a polyethylene foam material).

In some embodiments, it may be advantageous for the unitary body to not have sharp corners of less than or equal to about 90°. Such sharp corners have a tendency to crack (e.g., break, tear, or otherwise physically deform) when the unitary body 102 is bent or twisted. In order to avoid cracking at such sharp corners, the cushioning device 100' has rounded corners in place of sharp corners. In particular, the second coupling mechanism 110 includes rounded corners 111, the neck 112 includes rounded corners 113, and the slot 116 includes rounded corners 117. In some embodiments, the rounded corners have a radius in a range between about 1 mm (0.039 in) and about 10 mm (0.394 in), or in a range between about 3 mm (0.118 in) and about 8 mm (0.315 in), or between about 4 mm (0.157 in) and about 6 mm (0.236 in). In particular, the rounded corners 113 can have a radius of about 5 mm (0.197 in).

While the cushioning device 100' is a variation of the cushioning device 100, it will be apparent that rounded corners could be used with any of the cushioning devices described herein. Thus, to the extent that any of the cushioning devices described herein have sharp corners, such as corners having an angle less than or equal to about 90°, those sharp corners can be replaced with rounded corners. In that sense, applicant submits that any use of the term "corner" herein will include either a sharp corner or a rounded corner and any depiction of a sharp corner in the Figures could be replaced by a rounded corner.

For purposes of this disclosure, terminology such as "upper," "lower," "vertical," "horizontal," "inwardly," "outwardly," "inner," "outer," "front," "rear," and the like, should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Unless stated otherwise, the terms "substantially," "approximately," and the like are used to mean within 5% of a target value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

What is claimed is:

1. A package comprising:

a container;

an object located within the container, the object having a plurality of corners; and a plurality of cushioning devices, wherein each of the plurality of cushioning devices is located between one of the plurality of corners of the object and the container, and wherein each of the plurality of cushioning devices is a cushioning device having a unitary body formed from a resilient material, the unitary body having:

a length, a width, and a thickness, wherein the length of the unitary body is greater than the width of the unitary body;

first and second ends located opposite each other in a direction of the length of the unitary body;

first and second coupling mechanisms located on the first and second ends of the unitary body, wherein, when the unitary body is in a looped configuration, the first and second coupling mechanisms are configured to be coupled to each other to hold the unitary body in the looped configuration; and a slot through the thickness of the unitary body, wherein, when the unitary body is in the looped configuration, the slot is capable of having a side or a corner of an object slid therethrough so that the unitary body in the looped configuration provides cushioning for the side or the corner of the object.

2. The package of claim 1, wherein the object has a contoured surface.

3. The package of claim 1, wherein at least one of the plurality of corners of the object is a rounded corner.

4. The package of claim 1, wherein the object has substantially planar surfaces.

5. The package of claim 1, wherein the container is a shipping box, and wherein the width of each of the plurality of cushioning devices is located between front and back surfaces of the shipping box.

* * * * *